US010737130B2

(12) United States Patent
Hsu

(10) Patent No.: US 10,737,130 B2
(45) Date of Patent: Aug. 11, 2020

(54) COMBINED EXERCISE APPARATUS

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 110 days.

(21) Appl. No.: 15/991,154

(22) Filed: May 29, 2018

(65) Prior Publication Data

US 2019/0366148 A1 Dec. 5, 2019

(51) Int. Cl.

| | |
|---|---|
| ***A63B 21/062*** | (2006.01) |
| ***A63B 23/035*** | (2006.01) |
| ***A63B 7/04*** | (2006.01) |
| ***A63B 21/00*** | (2006.01) |
| ***A63B 21/22*** | (2006.01) |

(52) U.S. Cl.

CPC ..... *A63B 21/0628* (2015.10); *A63B 7/045* (2013.01); *A63B 21/00192* (2013.01); *A63B 23/03525* (2013.01); *A63B 21/22* (2013.01); *A63B 2208/0204* (2013.01)

(58) Field of Classification Search

CPC ..... A63B 21/0628; A63B 21/00058; A63B 21/00065; A63B 21/00192; A63B 21/0085; A63B 21/0088; A63B 21/22; A63B 21/225; A63B 21/151; A63B 21/153; A63B 21/154; A63B 21/155; A63B 21/156; A63B 7/04; A63B 7/045; A63B 23/03525; A63B 23/03566; A63B 23/1209; A63B 23/1218

See application file for complete search history.

(56) References Cited

U.S. PATENT DOCUMENTS 4,390,179 A * 6/1983 Szkalak ..... A63B 21/154 482/100
4,620,703 A * 11/1986 Greenhut ..... A63B 21/0056 482/114
4,798,378 A * 1/1989 Jones ..... A63B 21/0052 482/72
5,051,638 A * 9/1991 Pyles ..... A63B 21/0051 310/105

(Continued)

FOREIGN PATENT DOCUMENTS

TW I551330 B 10/2016

*Primary Examiner* — Loan B Jimenez
*Assistant Examiner* — Catrina A Letterman
(74) *Attorney, Agent, or Firm* — Rosenberg, Klein & Lee

(57) ABSTRACT

A combined exercise apparatus includes a lat pull-down machine and a rope pulling exercise machine. The lat pull-down machine includes a first handle, a first pull rope, and a first resistance module. The first handle is connected with the first resistance module through the first pull rope for providing lat pull-down training through the first resistance module. The rope pulling exercise machine is mounted to the lat pull-down machine. The rope pulling exercise machine includes a rope, a wheel seat, and a second resistance module. The rope is wound around the wheel seat. The wheel seat is connected with the second resistance module for providing rope pulling training through the second resistance module. Wherein, the first resistance module of the lat pull-down machine and the second resistance module of the rope pulling exercise machine are independent from each other.

10 Claims, 22 Drawing Sheets

(56) References Cited

U.S. PATENT DOCUMENTS 5,316,535 A * 5/1994 Bradbury ..... A63B 23/1209 482/114
5,354,251 A * 10/1994 Sleamaker ..... A63B 21/156 482/96
5,697,869 A * 12/1997 Ehrenfried ..... A63B 21/0058 482/129
6,261,208 B1 7/2001 Carson, Jr.
6,565,490 B2 * 5/2003 O'Hearn ..... A63B 21/0628 482/102
6,790,163 B1 * 9/2004 Van De Laarschot ..... A63B 21/0056 434/254
7,018,323 B1 * 3/2006 Reynolds ..... A63B 7/04 482/112
7,044,897 B2 * 5/2006 Myers ..... A63B 21/063 482/138
7,524,272 B2 * 4/2009 Bruck ..... A63B 21/153 482/126
8,096,926 B1 * 1/2012 Batca ..... A63B 21/00058 482/92
8,647,239 B1 * 2/2014 Sokolovas ..... A63B 69/10 482/55
9,656,116 B2 * 5/2017 Giannelli ..... A63B 21/063
10,016,645 B1 * 7/2018 Reynolds ..... A63B 21/008
10,143,880 B1 * 12/2018 Boatwright ..... A63B 21/075
2004/0014568 A1 * 1/2004 Williams ..... A63B 7/04 482/37
2005/0148437 A1 * 7/2005 Ryan ..... A63B 21/018 482/37
2006/0030460 A1 * 2/2006 Ish, III ..... A63B 21/156 482/99
2007/0167294 A1 * 7/2007 Lin ..... A63B 21/0051 482/63
2009/0137370 A1 * 5/2009 Kushnir ..... A63B 21/00069 482/120
2010/0041520 A1 * 2/2010 Popescu ..... A63B 21/015 482/37
2014/0274600 A1 * 9/2014 Dalebout ..... A63B 21/225 482/115
2015/0051056 A1 * 2/2015 Scheffer ..... A63B 69/0028 482/124
2017/0106222 A1 * 4/2017 Mayer ..... F16D 55/2245
2017/0319941 A1 * 11/2017 Smith ..... A63B 21/157
2018/0185698 A1 * 7/2018 Anderson ..... A63B 21/0051
2018/0256933 A1 * 9/2018 Olson ..... A63B 21/00192
2019/0076691 A1 * 3/2019 Smith ..... A63B 21/154
2019/0321680 A1 * 10/2019 Manzke ..... A63B 22/02

* cited by examiner

COMBINED EXERCISE APPARATUS

FIELD OF THE INVENTION

The present invention relates to an exercise apparatus, and more particularly, to a combined exercise apparatus.

BACKGROUND OF THE INVENTION

Most of conventional exercise apparatuses provide a single function. This kind of exercise apparatus is difficult to provide users with more diverse training functions.

Taking a lat pull-down device as an example, the related patents include Taiwan Patent Publication No. 1551330 titled "pull-up fitness exercise device", Taiwan Patent Publication No. 201204428 titled "pulling and lifting body building device", etc. These traction training devices mainly include a counterweight assembly on a framework and a traction assembly composed of a pulley and a rope between stretching assemblies. The components can only be used for traction training. In addition, a rope pulling exercise apparatus can only be used for rope pulling training. The related patent includes U.S. Pat. No. 6,261,208 titled "rope pulling frictional exercise device".

As known from the above patents, an exercise apparatus only provides a specific training module. Although some exercise apparatuses provide more diverse training devices, how to integrate multiple training devices into one exercise apparatus (such as, selecting appropriate training devices to cooperate with each other and the arrangement of a variety of training devices) needs to be researched and developed.

SUMMARY OF THE INVENTION

The primary object of the present invention is to provide a combined exercise apparatus which provides diverse training functions and integrates different exercise machines into the exercise apparatus. The combined exercise apparatus of the present invention comprises a lat pull-down machine and a rope pulling exercise machine. The lat pull-down machine includes a first handle, a first pull rope, and a first resistance module. The first handle is connected with the first resistance module through the first pull rope for providing lat pull-down training through the first resistance module. The rope pulling exercise machine is mounted to the lat pull-down machine. The rope pulling training machine includes a rope, a wheel seat, and a second resistance module. The rope is wound around the wheel seat. The wheel seat is connected with the second resistance module for providing rope pulling training through the second resistance module. Wherein, the first resistance module of the lat pull-down machine and the second resistance module of the rope pulling training machine are independent from each other.

According to another aspect of the present invention, a combined exercise apparatus is provided. The combined exercise apparatus comprises a lat pull-down machine and a rope pulling exercise machine. The lat pull-down machine and the rope pulling exercise machine are integrated with each other.

Preferably, the first resistance module includes a first seat, a first rotator, and a first resistance unit. The first rotator is rotatably mounted to the first seat. The first rotator is linked by the first pull rope. The first rotator is provided with a plurality of blades arranged annularly to generate wind resistance when the first rotator is rotated. The first resistance unit includes a first reluctance unit. The first reluctance unit corresponds to the first rotator for the first rotator to generate reluctance.

Preferably, the first resistance module further includes a first resistance adjustment module connected with the first resistance unit for adjusting the reluctance acting on the first rotator.

Preferably, the second resistance module includes a second seat, a second rotator, and a second resistance unit. The second rotator is rotatably mounted to the second seat. The second rotator is linked to the wheel seat. The second resistance unit includes a second reluctance unit. The second reluctance unit corresponds to the second rotator for the second rotator to generate reluctance.

Preferably, the second resistance module further includes a second resistance adjustment module connected with the second resistance unit for adjusting the reluctance acting on the second rotator.

Preferably, the first resistance unit is movably mounted to the first seat. The first resistance adjustment module includes a first operation member and a first pull cord. The first pull cord is connected with the first operation member and the first resistance unit. When the first operation member is turned, the first operation member drives the first resistance unit through the first pull cord for adjusting the first resistance unit to correspond to the position of the first rotator.

Preferably, the second resistance unit is movably mounted to the second seat. The second resistance adjustment module includes a second operation member and a second pull cord. The second pull cord is connected with the second operation member and the second resistance unit. When the second operation member is turned, the second operation member drives the second resistance unit through the second pull cord for adjusting the second resistance unit to correspond to the position of the second rotator.

Preferably, the first handle includes at least a pair of first handles. The lat pull-down machine further includes a pair of handle seats and a pair of angle adjustment members. The pair of first handles is mounted to the handle seats, respectively. The angle adjustment members are used to retain the position of the handle seats.

Preferably, the rope of the rope pulling machine is located between the pair of handle seats.

Preferably, the lat pull-down machine further includes a second handle and a second pull rope. The second pull rope is connected with the second handle and the first resistance module, so that the second handle and the first handle share the first resistance module.

Preferably, the first resistance module includes a first seat, a first rotator, at least one movable sleeve, at least one elastic cord, at least one one-way bearing, and at least one drive pulley. The first rotator is rotatably mounted to the first seat. The first rotator is linked by the first pull rope. The first rotator is provided with a plurality of blades arranged annularly. The blades are used to generate wind resistance. The movable sleeve is rotatably mounted on the first rotator through the one-way bearing. The movable sleeve has a first winding portion and a second winding portion. The first winding portion is configured for winding of a cord of the drive pulley. One end of the elastic cord is connected to the second winding portion. The drive pulley is linked by the first pull rope, so that the drive pulley pulls the first rotator to rotate through the cord, and the elastic cord is wound around the second winding portion to store a return elastic force.

Preferably, the first resistance module further includes a first resistance unit. The first rotator further includes a pulley. The pulley drives a second rotator to rotate through a belt. The pulley has a diameter greater than that of the second rotator. The first resistance unit includes a first reluctance unit. The first reluctance unit corresponds to the second rotator for the second rotator to generate reluctance.

According to the above technical features, the present invention can achieve the following effects:

1. The combined exercise apparatus provides diverse training functions and integrates the lat pull-down machine and the rope pulling machine into the exercise apparatus.

2. The first resistance module of the lat pull-down machine can utilize wind resistance and reluctance to provide a training load without increasing the overall weight.

3. The second resistance module of the rope pulling machine can utilize reluctance to provide a training load without increasing the overall weight.

4. The angle of the first handle of the lat pull-down machine is adjustable according to the user's needs.

5. The training load of the rope pulling machine and the training load of the lat pull-down machine are adjustable so that the training load can be appropriately adjusted according to the user's needs.

6. In addition to the first handle, the lat pull-down machine may provide a second handle and may share the same first resistance module to simplify the required components.

7. The movable sleeve is configured for winding of the cord of the drive pulley and the elastic cord for driving the drive pulley to rotate or to rotate reversely by the elastic force of the elastic cord. The structure is simple and easy to implement. The elastic cord is an external component, which can be replaced and maintained easily.

8. The first rotator and the second rotator are linked by the first resistance module through the pulley. Since the diameter of the pulley is greater than the diameter of the second rotator, the rotational speed of the second rotator can be increased, thereby enhancing the magnetic brake effect to increase the training load.

DETAILED DESCRIPTION OF THE PREFERRED EMBODIMENTS

Embodiments of the present invention will now be described, by way of example only, with reference to the accompanying drawings.

Figure 1:
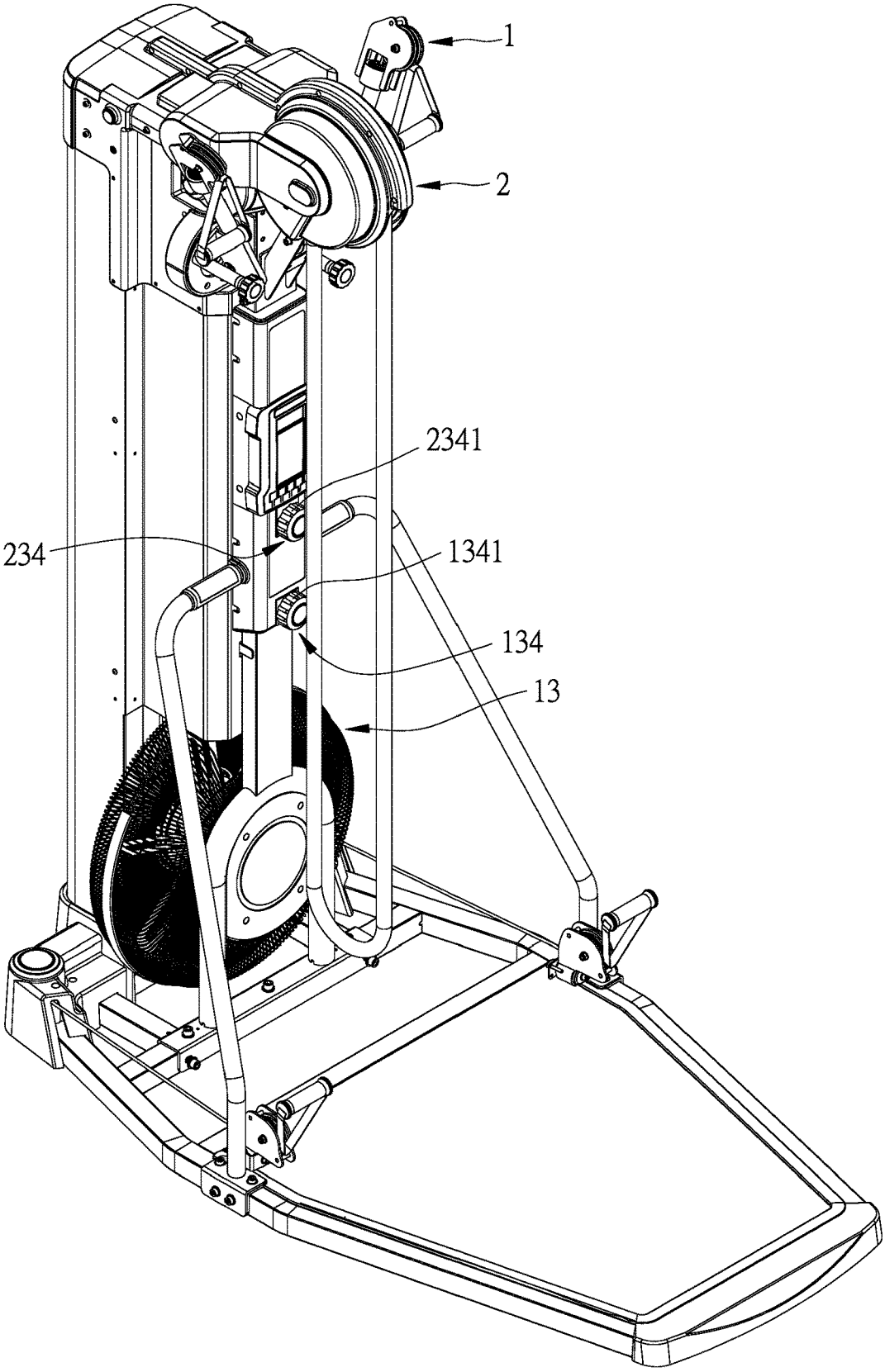
FIG. 1 is a perspective view in accordance with a first embodiment of the present invention.

Referring to FIG. 1, a combined exercise apparatus according to an embodiment of the present invention comprises a lat pull-down machine (1) and a rope pulling exercise machine (2). The rope pulling training machine (2) and the lat pull-down machine (1) are integrated with each other for lat pull-down training or rope pulling training. Wherein, the lat pull-down machine (1) and the rope pulling training machine (2) are operated independently from each other.

Figure 2A:
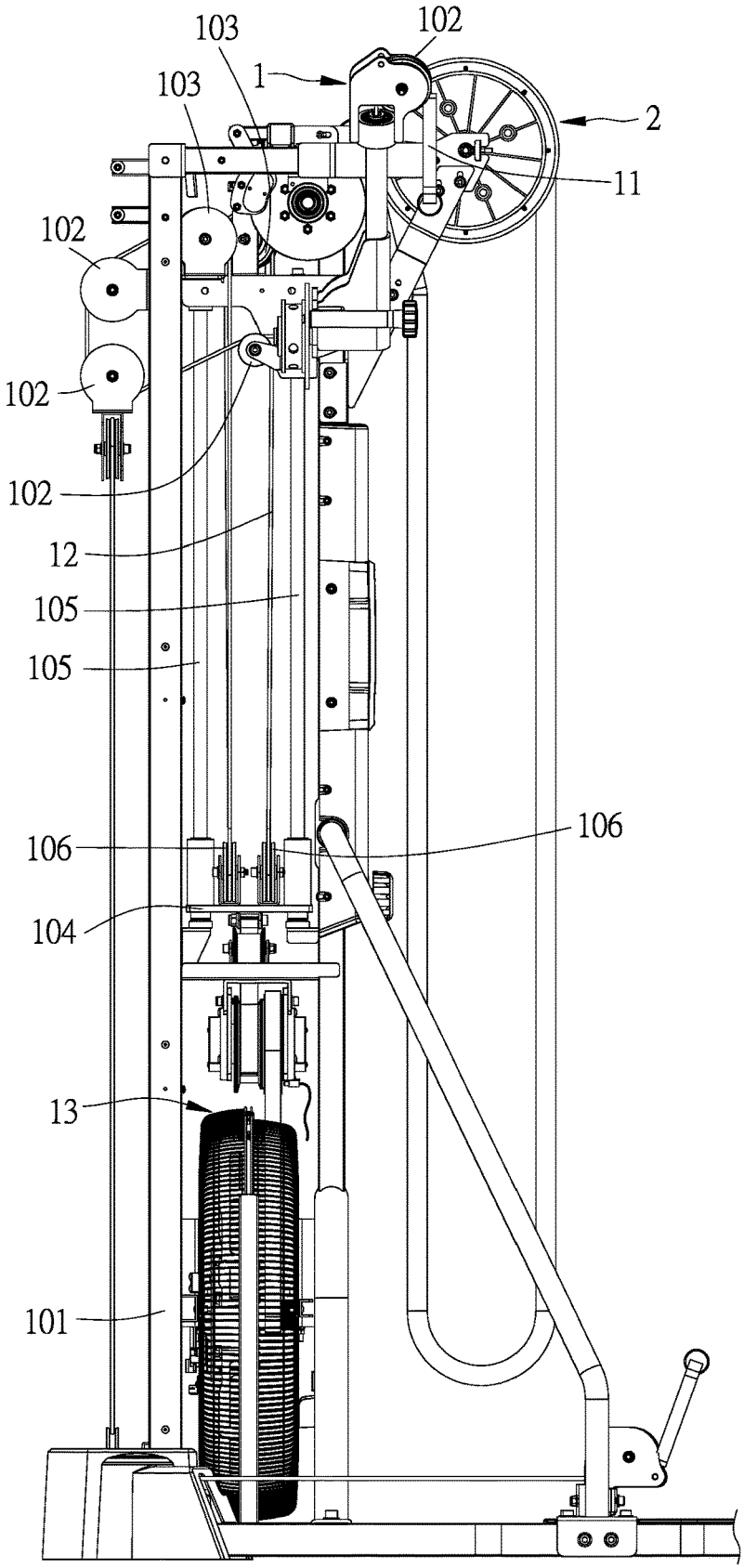
FIG. 2A is a side view in accordance with the first embodiment of the present invention, without the casing.
Figure 2B:
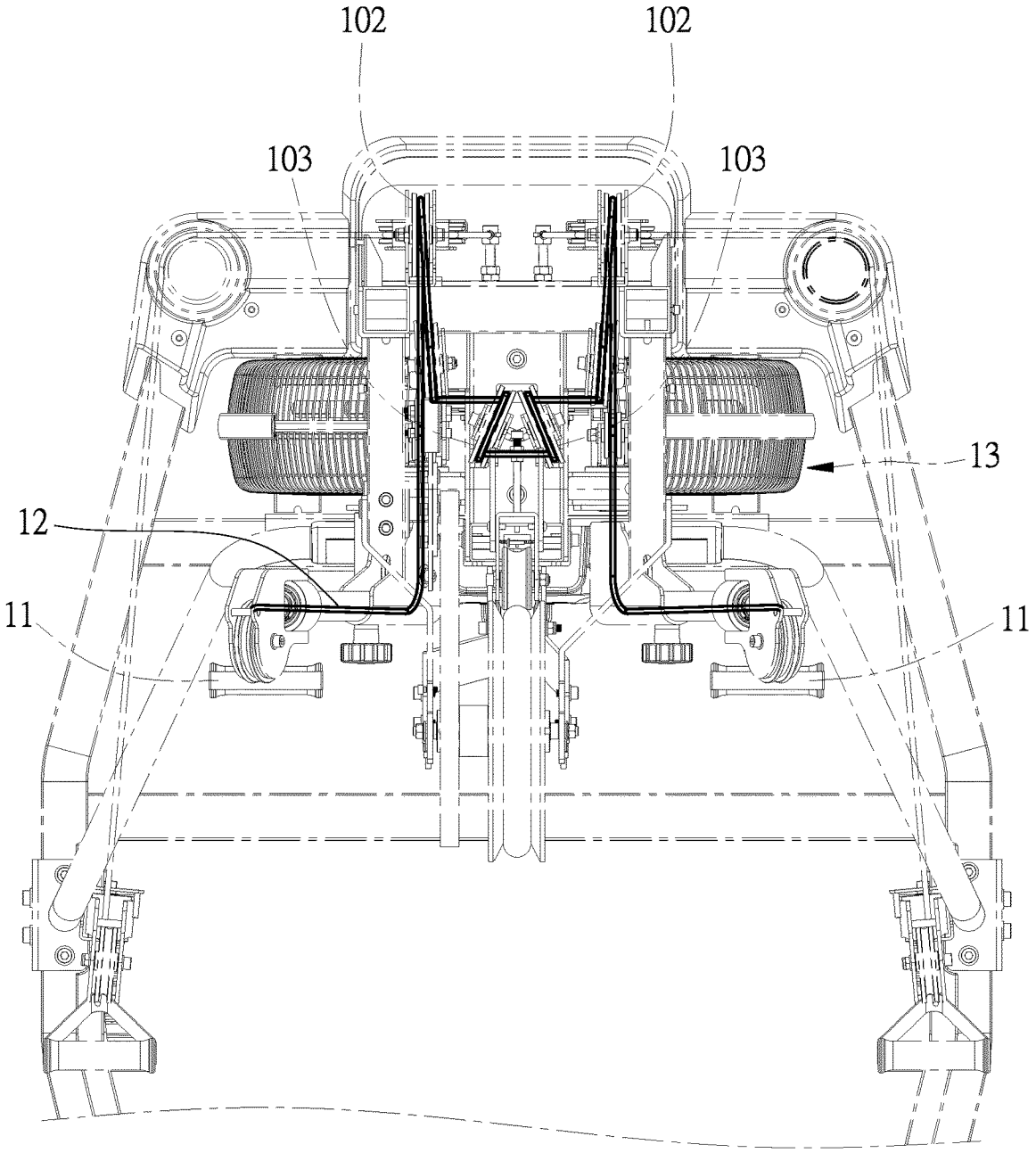
FIG. 2B is a top view in accordance with the first embodiment of the present invention, without the casing.

Referring to FIG. 2A and FIG. 2B, the lat pull-down machine (1) includes two first handles (11), a first pull rope (12), and a first resistance module (13). The first handles (11) are connected with the first resistance module (13) through the first pull rope (12) for providing lat pull-down training through the first resistance module (13). In detail, the lat pull-down machine (1) comprises a main seat (101), a plurality of first guide winding members (102), and a plurality of first support winding members (103). The two handles (11) are paired with each other and disposed on the top of the main seat (101). The first guide winding members (102) are arranged on the main seat (101). The first support winding members (103) are arranged approximately at the center of the top of the main seat (101). In addition, the first resistance module (13) is installed at the central bottom of the main seat (101). The main seat (101) further includes a displacement seat (104) and a plurality of guide rods (105). The guide rods (105) are substantially arranged vertically. The displacement seat (104) is slidably disposed on the guide rods (105). The displacement seat (104) is used to drive the first resistance module (13). The displacement seat (104) is provided with a plurality of second support winding members (106) thereon. One end of the first pull rope (12) is connected to one of the first handles (11) and then wound around the first guide winding members (102), the first support winding members (103) and the second support winding members (106) in sequence. The other end of the first pull rope (12) is connected to the other one of the two first handles (11). Thereby, the first handles (11) can be pulled to link the displacement seat (104), so that the first resistance module (13) can be linked by the displacement seat (104) to provide a training load.

Figure 3:
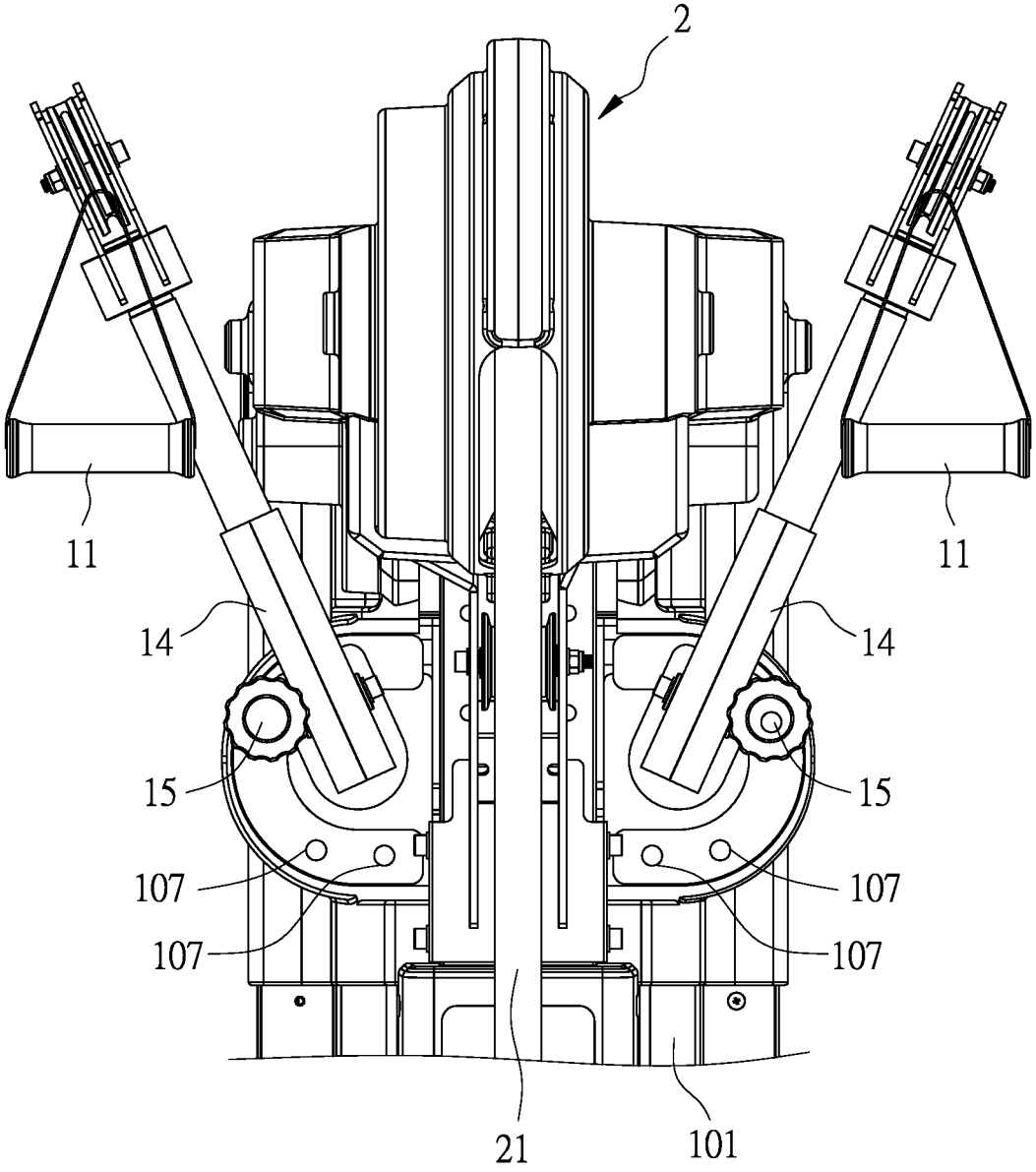
FIG. 3 is a partial front view in accordance with the first embodiment of the present invention.
Figure 4:
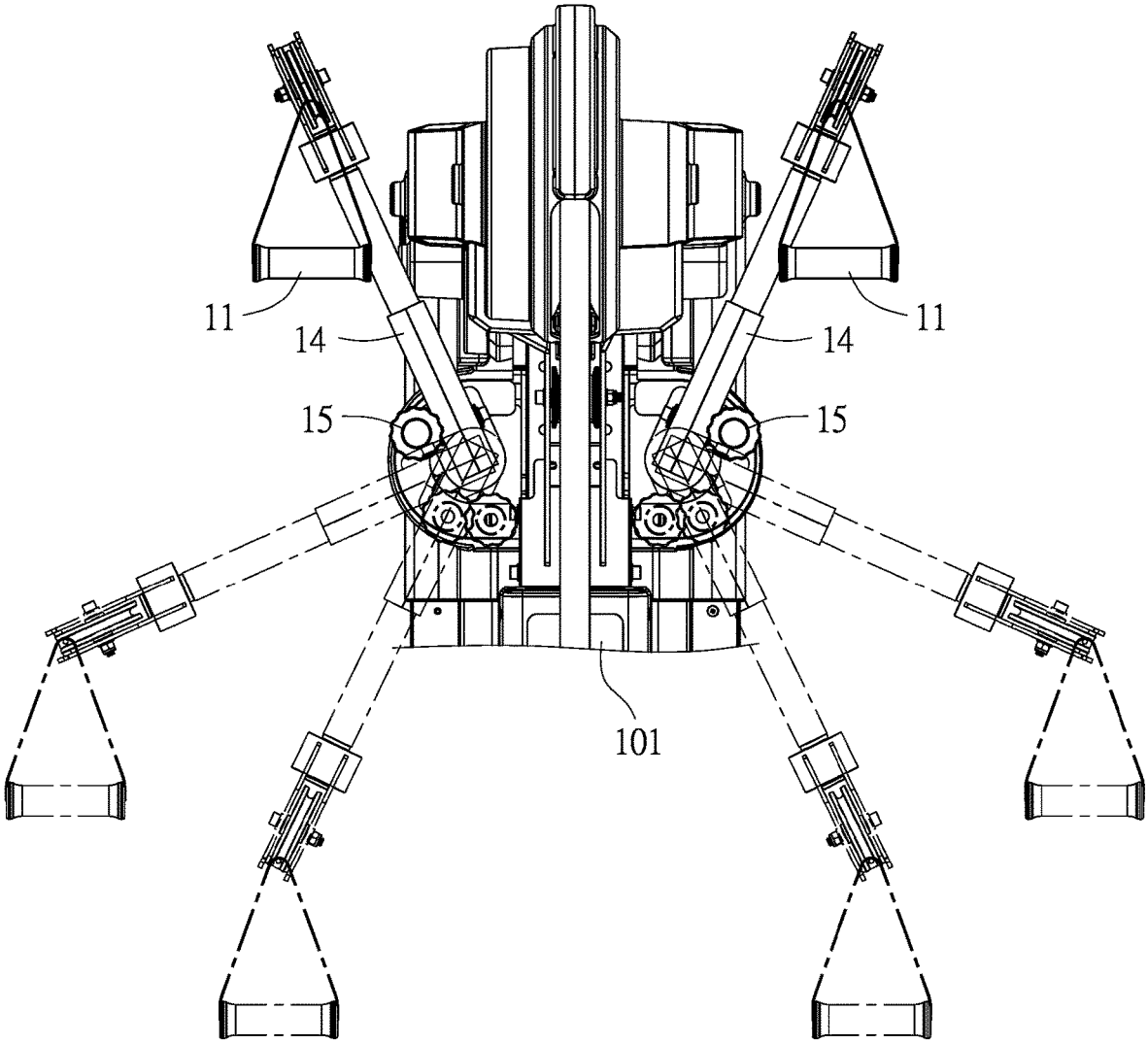
FIG. 4 is a partial front view in accordance with the first embodiment of the present invention when in use.

Referring to FIG. 3 and FIG. 4, in this embodiment, the first handles (11) can adjust their use angle. In particular, the lat pull-down machine (1) further includes a pair of handle seats (14) and a pair of angle adjustment members (15). The pair of handle seats (14) are rotatably disposed on the top of the main seat (101). The first handles (11) are mounted to the handle seats (14), respectively. The angle adjustment members (15) are used to retain the position of the handle seats (14). For example, the main seat (101) is provided with a plurality of insertion holes (107) around the periphery of each handle seat (14). The angle adjustment member (15) is selectively inserted into one of the insertion holes (107), so that the angles of the handle seats (14) and the first handles (11) are adjustable. Preferably, the rope (21) described below of the rope pulling machine (2) is located between the pair of handle seats (14) to make use of the space for operation.

Figure 5:
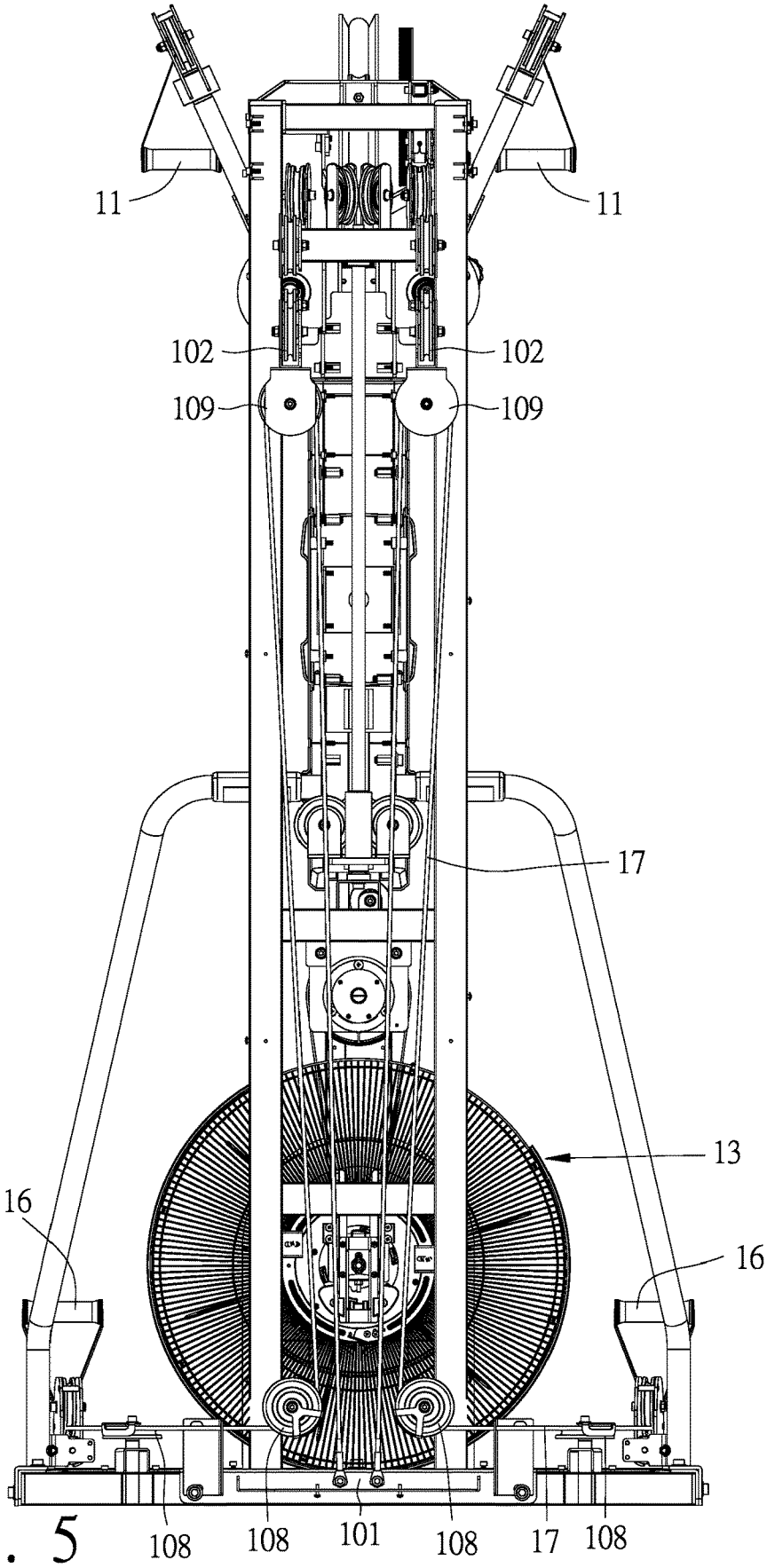
FIG. 5 is a rear view in accordance with the first embodiment of the present invention, without the casing.

Referring to FIG. 5, in this embodiment, the lat pull-down machine further includes two second handles (16) and two second pull ropes (17). The second pull rope (17) is connected with the second handle (16) and the first resistance module (13). The second handles (16) and the first handles (11) share the first resistance module (13). In detail, two of the first guide winding members (102) are movable. The bottom of the main seat (101) is provided with a plurality of second guide winding members (108) and two linking winding members (109). The two linking winding members (109) are connected with the two movable first guide winding members (102). One end of each second pull rope (17) is connected to the corresponding second handle (16). The second pull rope (17) is wound around the corresponding second guide winding member (108) and the corresponding linking winding member (109) in sequence and further connected to the main seat (101). Thereby, when the second handles (16) are pulled, the second linking winding members (109) are pulled by the second pull ropes (17) to drive the two movable guide winding members (108). Then, the first displacement seat (104) is linked to move through the first pull ropes (12) to generate a load, so that the first handles (11) and the second handles (16) can share the first resistance module (13).

Figure 6:
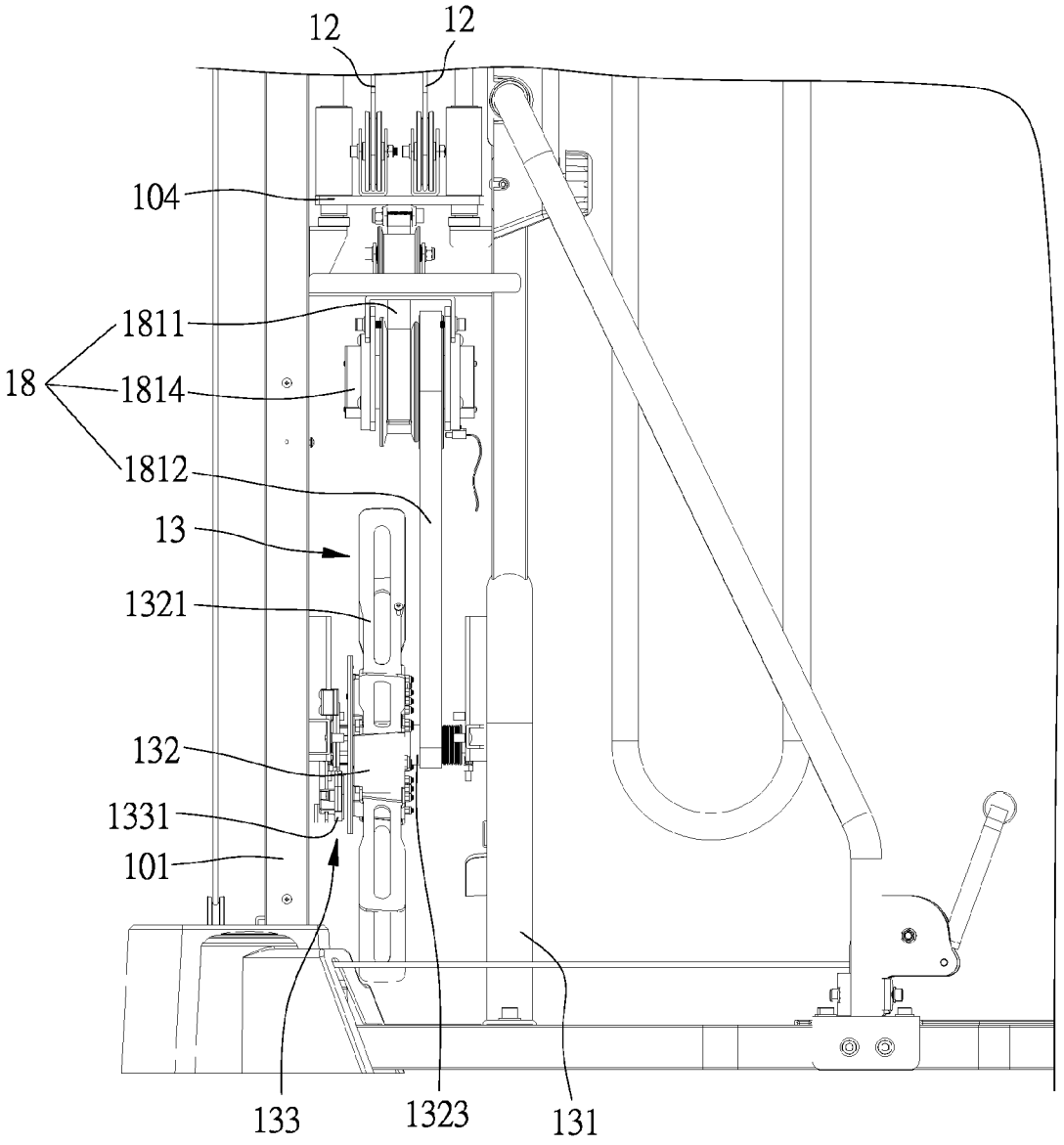
FIG. 6 is a partial side view in accordance with the first embodiment of the present invention, without the casing.
Figure 7:
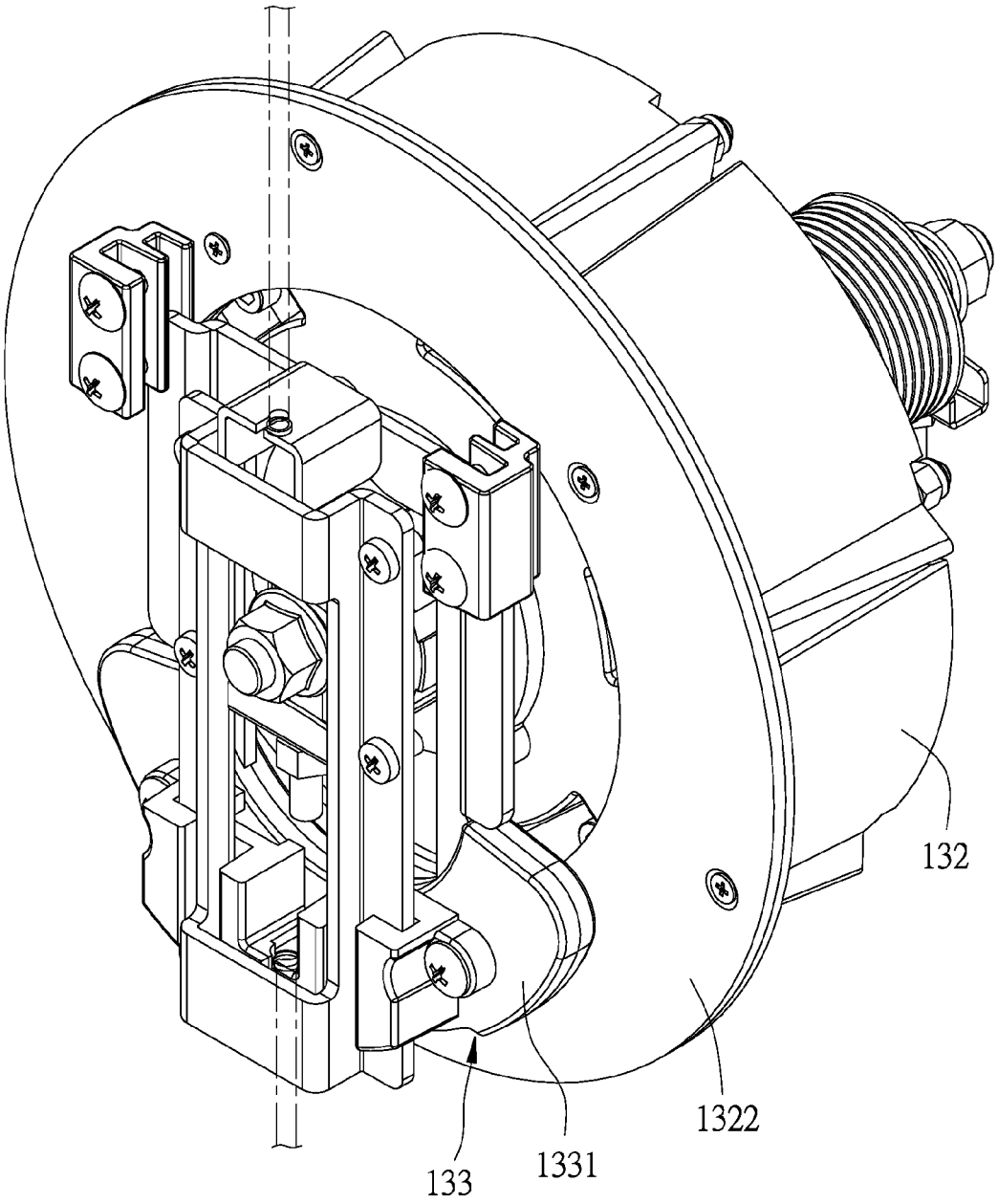
FIG. 7 is a perspective view of the first resistance module in accordance with the first embodiment of the present invention.

Referring to FIG. 6 and FIG. 7, the following further describes the specific content of the first resistance module (13) of this embodiment. The first resistance module (13) includes a first seat (131), a first rotator (132), and a first resistance unit (133). The first seat (131) is mounted to the main seat (101) to be regarded as the same seat. The first rotator (132) is rotatably mounted to the first seat (131). For example, the first rotator (132) is a wheel and is pivotally mounted on the first seat (131). The first rotator (132) is linked by the first pull ropes (12). The first rotator (132) is provided with a plurality of blades (1321) arranged annularly to generate wind resistance when the first rotator (132) is rotated. The first resistance unit (133) includes a first reluctance unit (1331). The first reluctance unit (1331) corresponds to the first rotator (132) for the first rotator (132) to generate reluctance. For example, the first reluctance unit (1331) may be a magnet, and the first rotator (132) may be a metal disc (1322) (such as an aluminum disc) to generate a magnetic brake by means of an eddy current effect.

Figure 8:
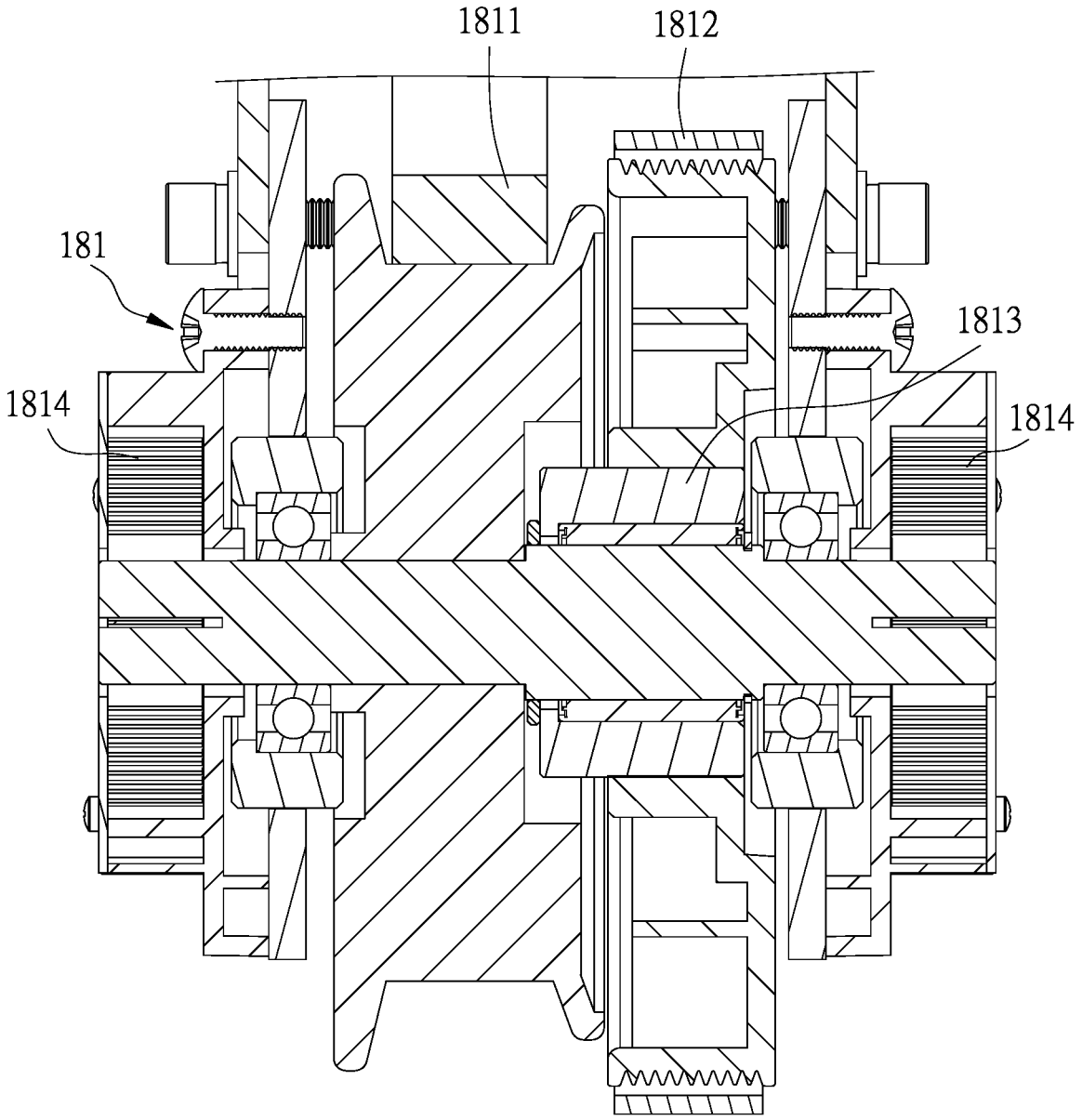
FIG. 8 is a cross-sectional view of the driven wheel in accordance with the first embodiment of the present invention.

Referring to FIG. 6 and FIG. 8, regarding the linking mechanism of the first rotator (132), in more detail, the mechanism of the first rotator (132) linked by the first pull ropes (12) is that the first rotator (132) is linked by the displacement seat (104) and a belt transmission mechanism (18). The belt transmission mechanism (18) may include a driven wheel (181). A pull belt (1811) and a linking belt (1812) are wound on the driven wheel (181). The pull belt (1811) is connected with the displacement seat (104). The linking belt (1812) is wound around a wheel axle (1323) of the first rotator (132) to drive the first rotator (132). Preferably, a one-way bearing (1813) is provided between the driven wheel (181) and the linking belt (1812), having the functions of unidirectional rotation and reverse idling, and can cooperate with a scroll spring (1814) (or other elastic member) to provide return elasticity.

Figure 9:
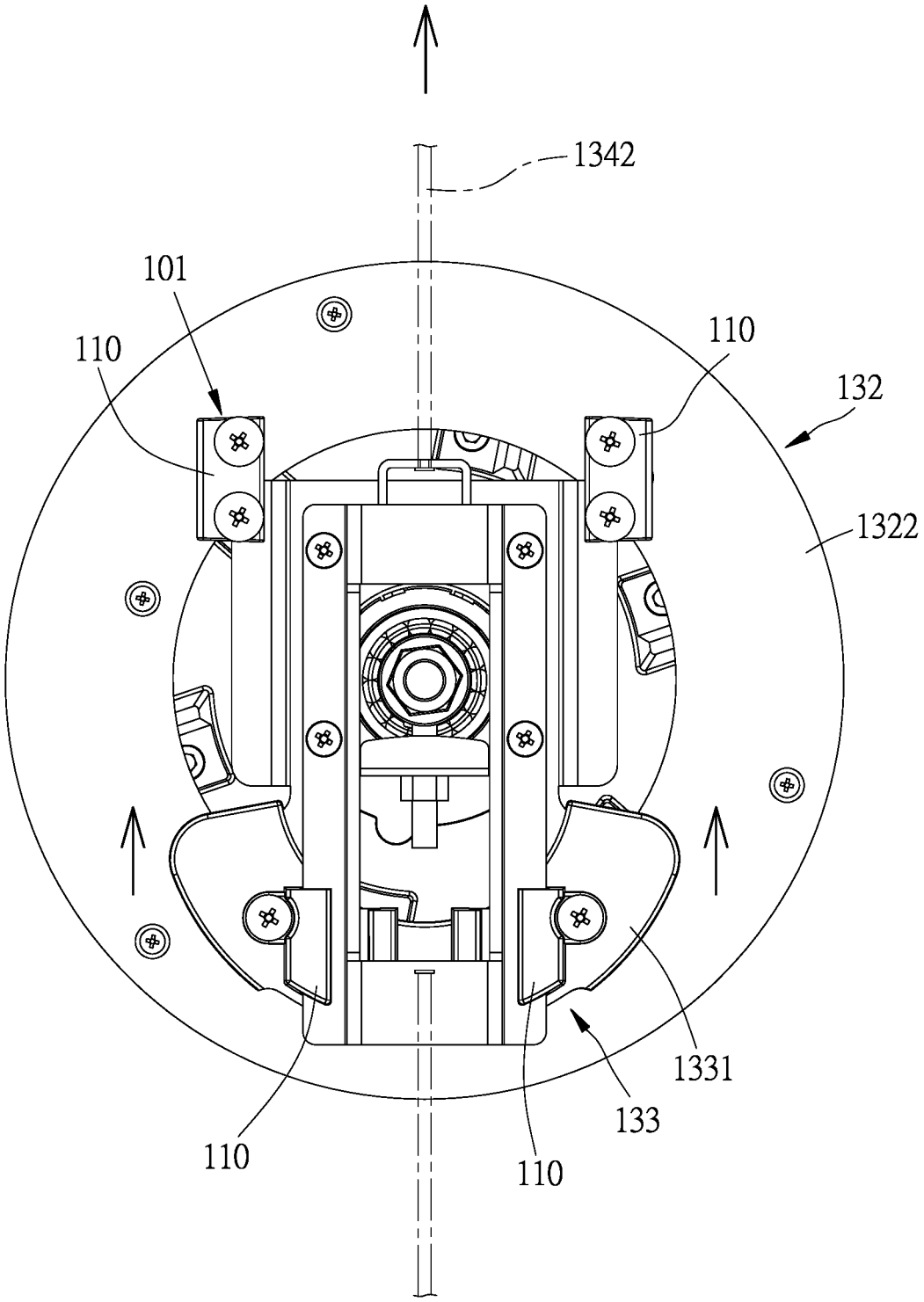
FIG. 9 is a planar view of the first resistance module in accordance with the first embodiment of the present invention.
Figure 10:
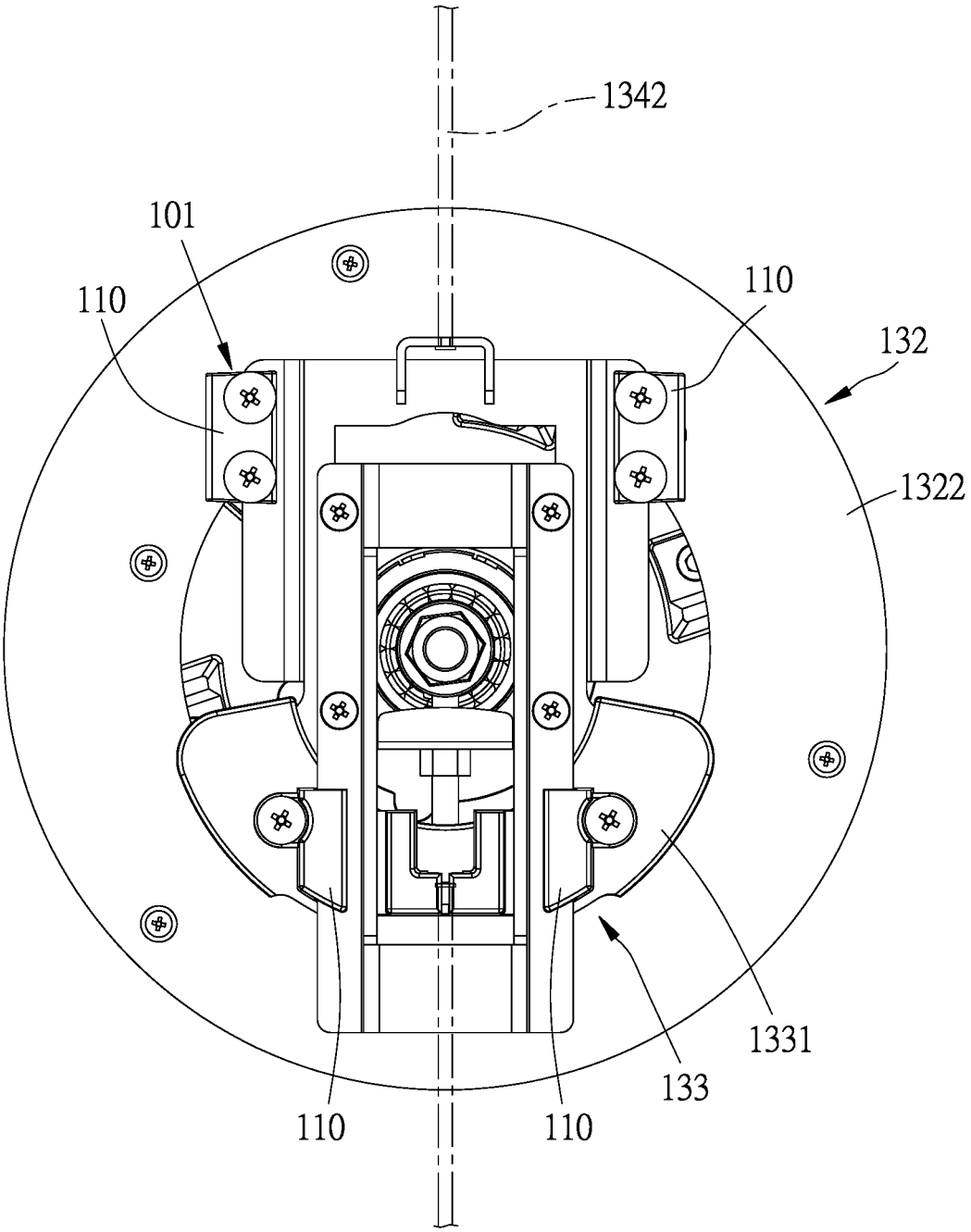
FIG. 10 is a planar view of the first resistance module in accordance with the first embodiment of the present invention when in use.

Please refer to FIG. 1 and FIG. 9. In this embodiment, the reluctance of the first resistance module (13) is adjustable. The first resistance module (13) further includes a first resistance adjustment module (134) connected with the first resistance unit (133) for adjusting the reluctance acting on the first rotator (132). In detail, the first resistance unit (133) is movably mounted to a slider (110) of the main seat (101). The first resistance adjustment module (134) includes a first operation member (1341) (such as, a knob) and a first pull cord (1342). The first pull cord (1342) is connected with the first operation member (1341) and the first reluctance unit (1331) of the first resistance unit (133) to pull the first pull cord (1342) while the first operation member (1341) is turned. Referring to FIG. 9 and FIG. 10, the first pull cord (1342) drives the first resistance unit (133) to adjust the first reluctance unit (1331) of the first resistance unit (133), corresponding to the position of the metal disc (1322) of the first rotator (132), so that the reluctance can be adjusted.

Figure 11:
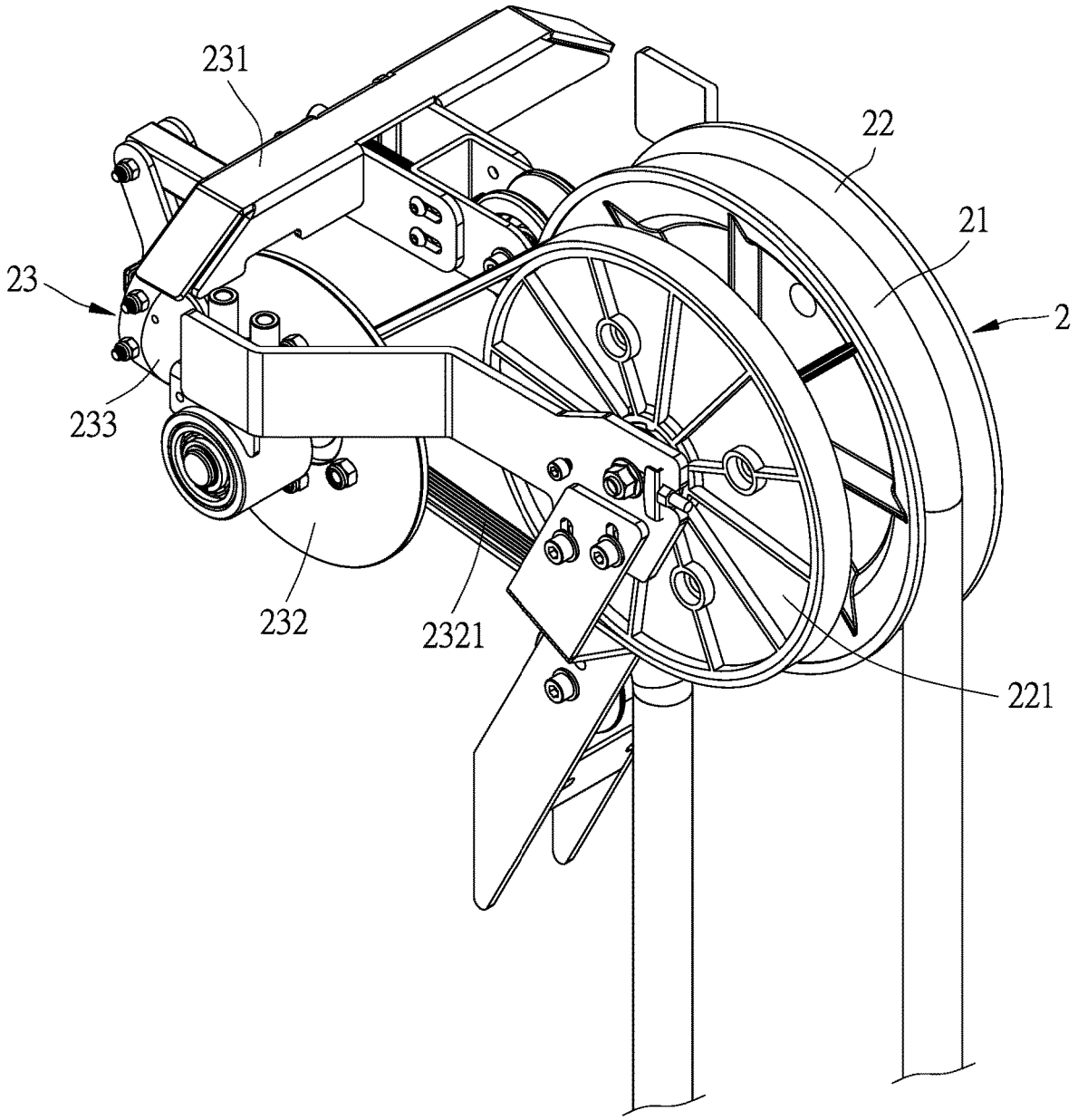
FIG. 11 is a partial perspective view of the rope pulling machine in accordance with the first embodiment of the present invention.
Figure 12:
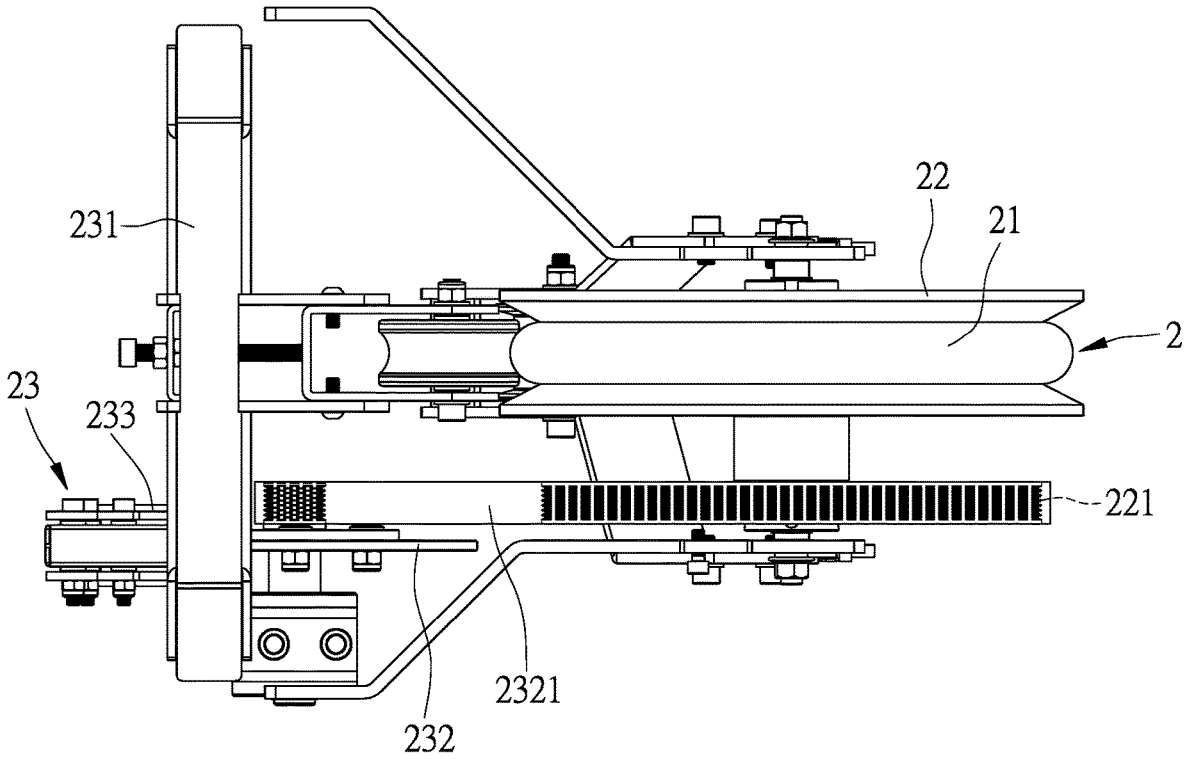
FIG. 12 is a top planar view of the rope pulling machine in accordance with the first embodiment of the present invention.

Referring to FIG. 11 and FIG. 12, the rope pulling machine (2) comprises a rope (21), a wheel seat (22), and a second resistance module (23). The rope (21) is wound around the wheel seat (22). The wheel seat (22) is connected with the second resistance module (23) for providing rope pulling training through the second resistance module (23). Specifically, the wheel seat (22) is connected with a linking wheel (221). The second resistance module (23) includes a second seat (231), a second rotator (232), and a second resistance unit (233). The second seat (231) is mounted to the main seat. That is, the second seat (231), the main seat and the first seat can be integrated with each other. The second rotator (232) is rotatably mounted to the second seat (231). For example, the second rotator (232) is a wheel and is pivotally connected to the second seat (231). A belt (2321) is connected between the second rotator (232) and the linking wheel (221), so that the second rotator (232) and the wheel seat (22) can be linked.

Figure 13:
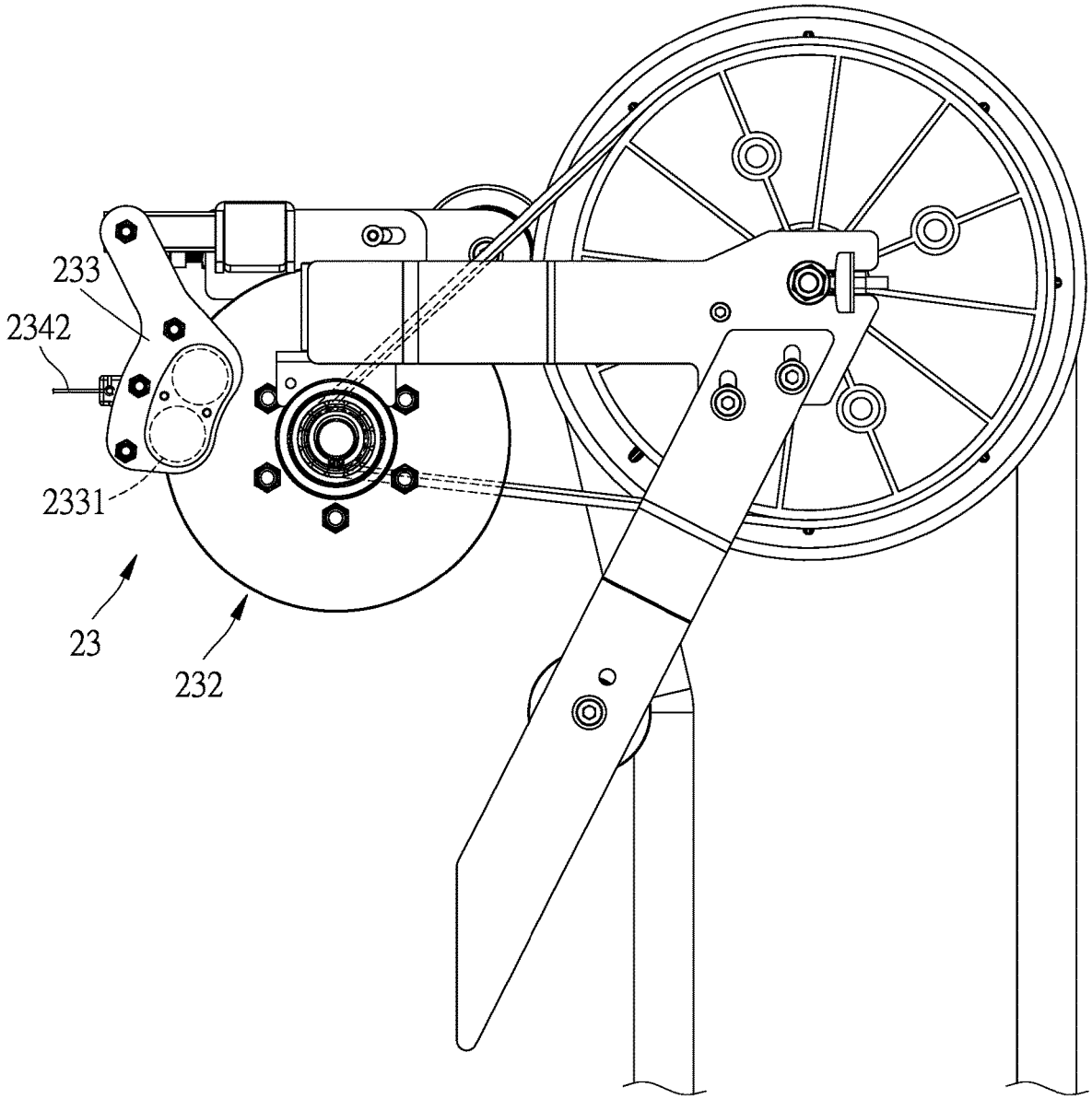
FIG. 13 is a side view of the rope pulling machine in accordance with the first embodiment of the present invention.
Figure 14:
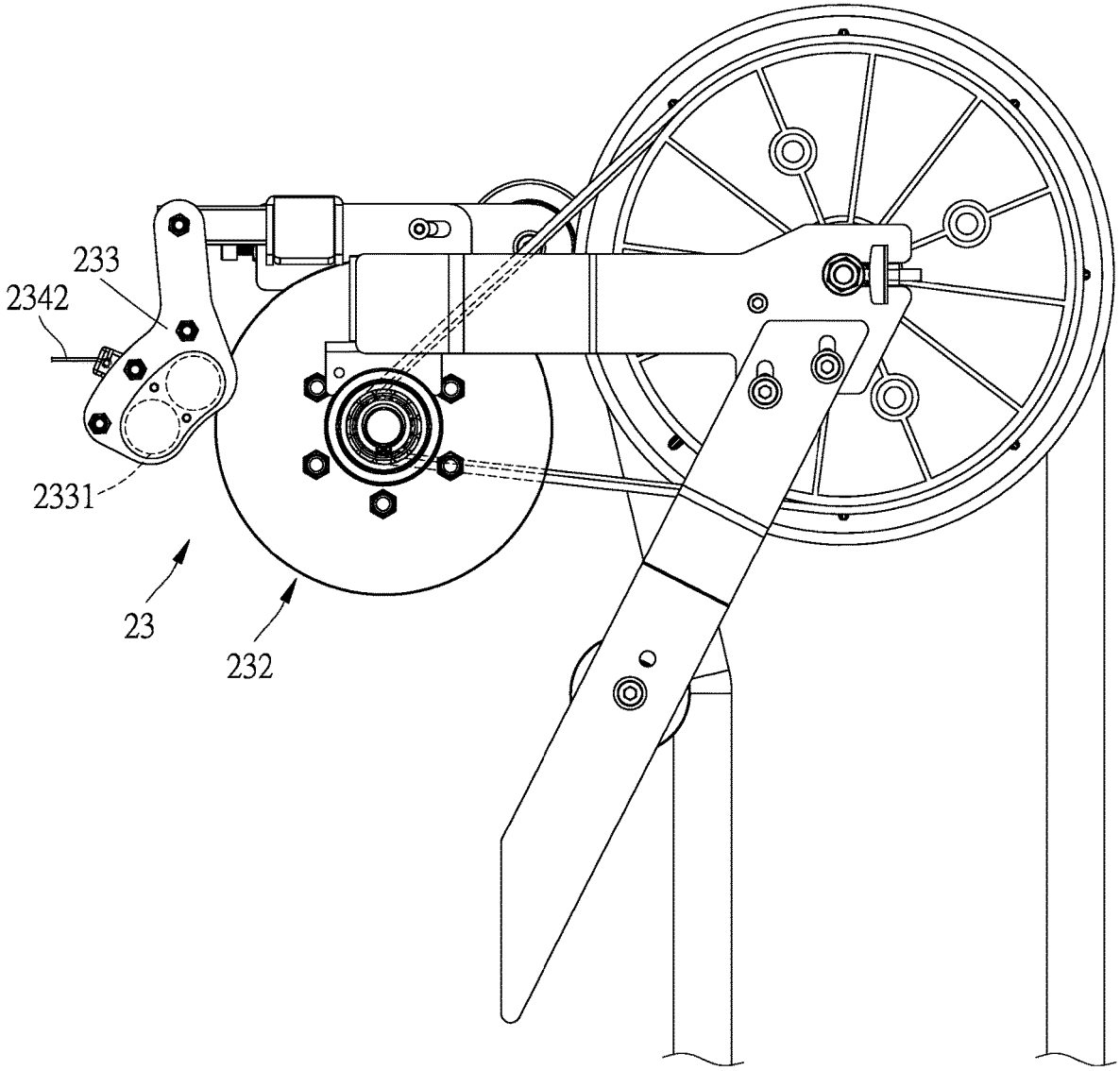
FIG. 14 is a side view of the rope pulling machine in accordance with the first embodiment of the present invention when in use.

Referring to FIG. 13, the second resistance unit (233) includes a second reluctance unit (2331). The second reluctance unit (2331) corresponds to the second rotator (232) for the second rotator (232) to generate reluctance (such as, by means of an eddy current effect). Referring to FIG. 13 and FIG. 1, preferably, the second resistance module (23) further includes a second resistance adjustment module (234). The second resistance adjustment module (234) is connected with the second resistance unit (233) for adjusting the reluctance acting on the second rotator (232). In detail, the second resistance unit (233) is movably mounted to the second seat (231) (such as, pivot connection). The second resistance adjustment module (234) includes a second operation member (2341) (such as, a knob) and a second pull cord (2342). The second pull cord (2342) is connected with the second operation member (2341) and the second resistance unit (233). When the second operation member (2341) is rotated, the second operation member (2341) drives the second resistance unit (233) through the second pull cord (2342). Referring to FIG. 13 and FIG. 14, the second reluctance unit (2331) of the second resistance unit (233) can be adjusted to correspond to the position of the second rotator (232) so as to adjust the reluctance.

Figure 15:
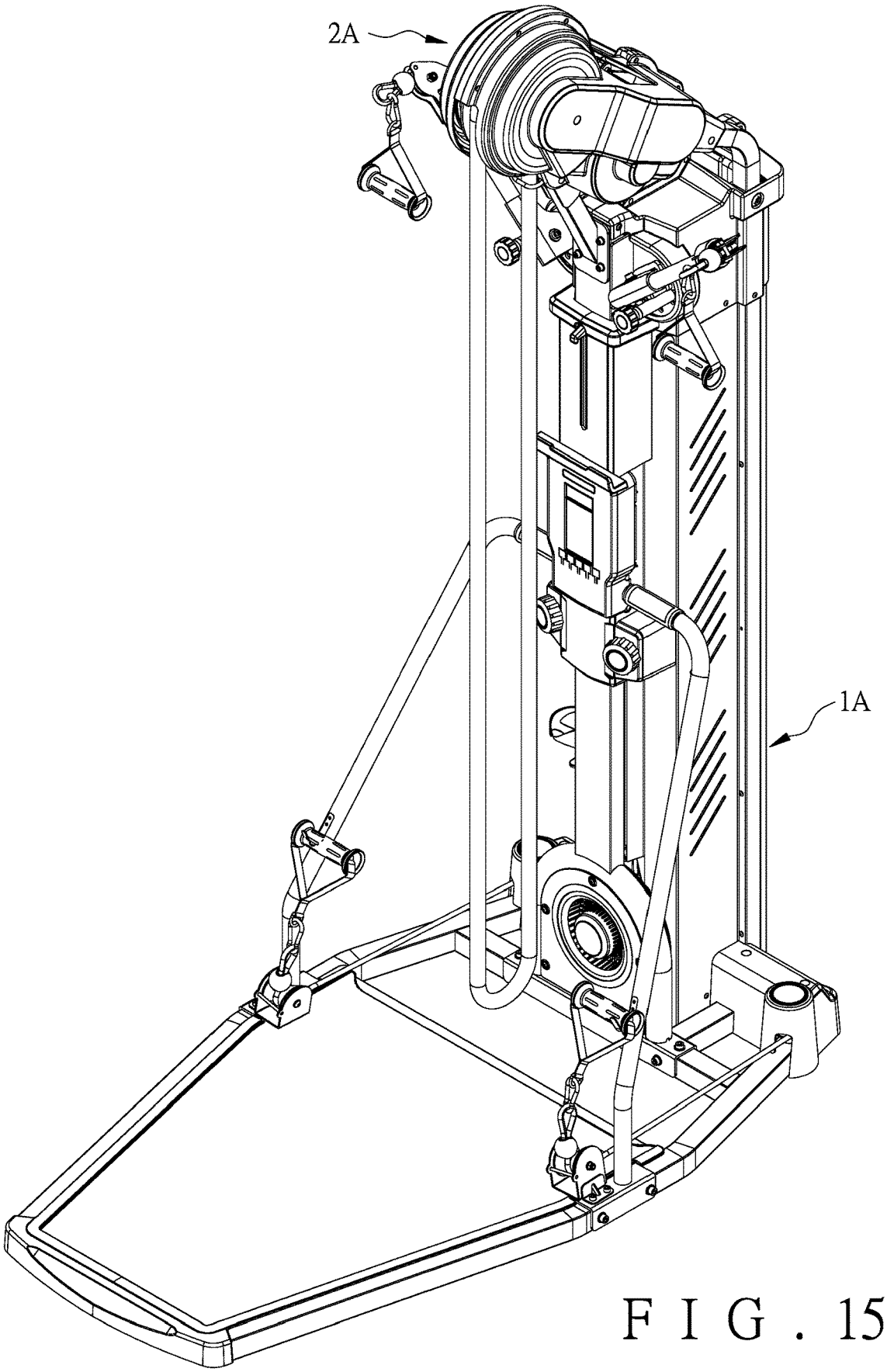
FIG. 15 is a perspective view in accordance with a second embodiment of the present invention.
Figure 16:
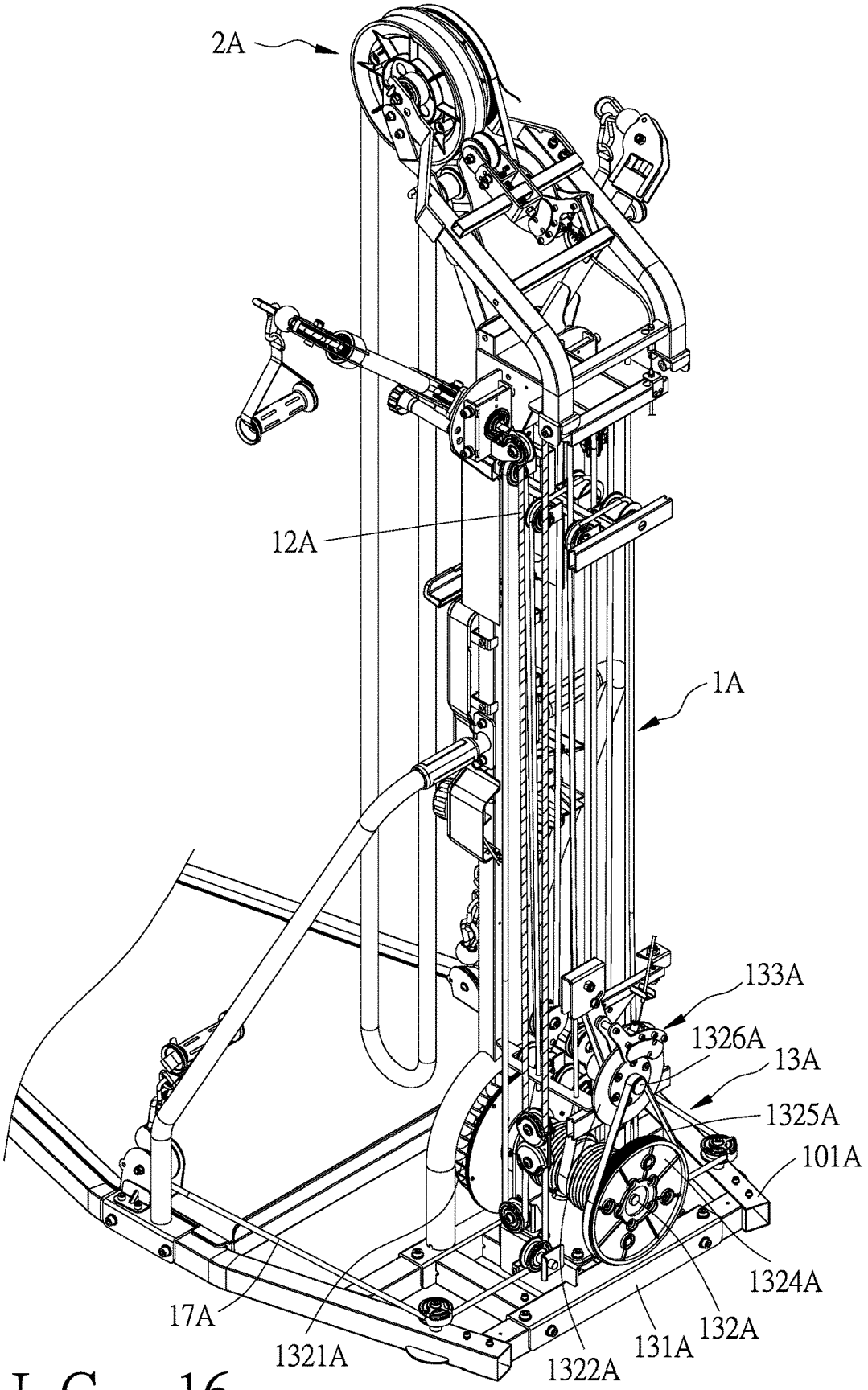
FIG. 16 is another perspective view in accordance with the second embodiment of the present invention, without the casing.

FIG. 15 and FIG. 16 illustrate another embodiment of the present invention, which is substantially similar to the aforesaid embodiment and comprises a lat pull-down machine (1A) and a rope pulling machine (2A). The lat pull-down machine (1A) and the rope pulling training machine (2A) are operated independently from each other. The main difference is that the first resistance module (13A) of the lat pull-down machine (1A) is different and that the linking structure of the first pull rope (12A), the second pull rope (17A) and the first resistance module (13A) is also different.

Figure 17:
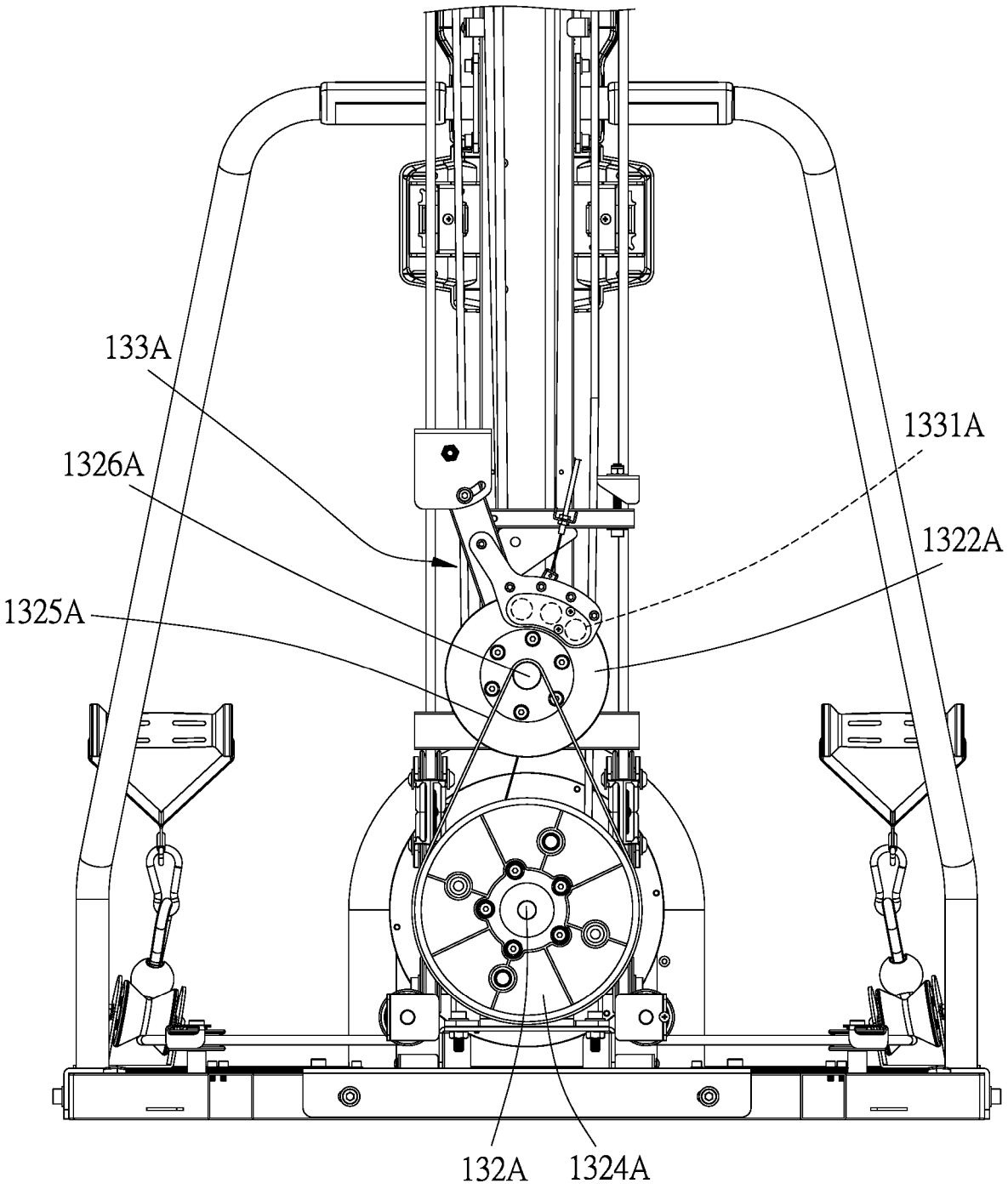
FIG. 17 is a partial rear view in accordance with the second embodiment of the present invention.
Figure 18:
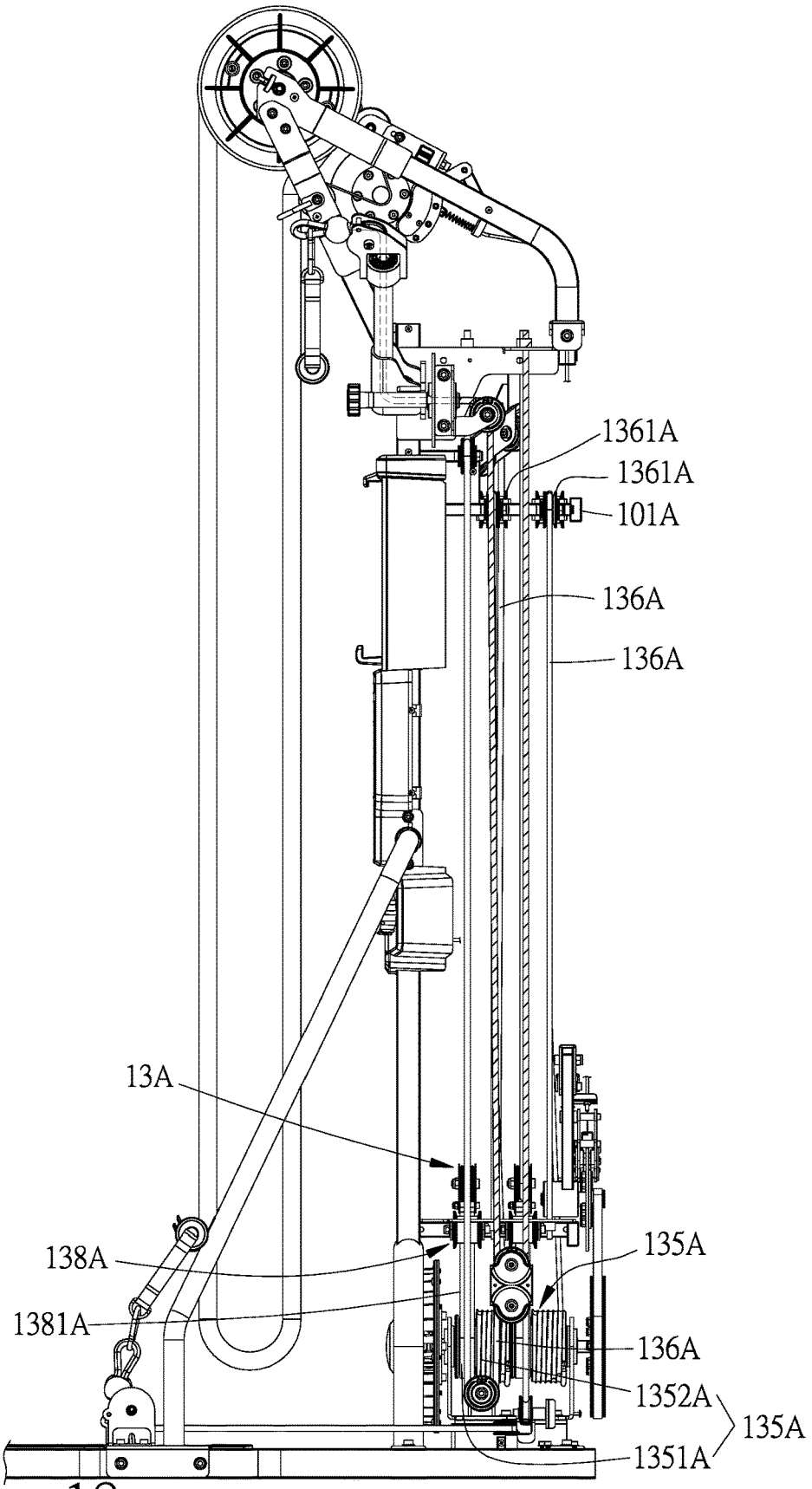
FIG. 18 is a side view in accordance with the second embodiment of the present invention.

Referring to FIG. 16 and FIG. 17, regarding the first resistance module (13A), in detail, the first resistance module (13A) includes a first seat (131A), a first rotator (132A), and a first resistance unit (133A). The first seat (131A) is mounted to the main seat (101A) of the lat pull-down machine (1A) to be regarded as the same seat. The first rotator (132A) is rotatably mounted to the first seat (131A). For example, the first rotator (132A) is a shaft and is pivotally mounted on the first seat (131A). The first rotator (132A) is linked by the first pull ropes (12A) or the second pull ropes (17A). The first rotator (132A) is provided with a plurality of blades (1321A) arranged annularly and a pulley (1324A). The blades (1321A) are used to generate wind resistance when the first rotator (132A) is rotated. Referring to FIG. 17 and FIG. 18, the pulley (1324A) drives a second rotator (1326A) to rotate through a belt (1325A). The diameter of the pulley (1324A) is greater than that of the second rotator (1326A), so that the rotational speed of the second rotator (1326A) is greater than the first rotator (132A) to increase the rotational speed of the second rotator (1326A). The first resistance unit (133A) includes a first reluctance unit (1331A). The first reluctance unit (1331A) corresponds to the second rotator (1326A) for the second rotator (1326A) to generate reluctance. For example, the first reluctance unit (1331A) may be a magnet, and the second rotator (1326A) may be a metal disc (1322A) (such as an aluminum disc) to generate a magnetic brake by means of an eddy current effect. This embodiment can further enhance the magnetic brake effect through the second rotator (1326A) with a higher rotational speed.

Figure 19:
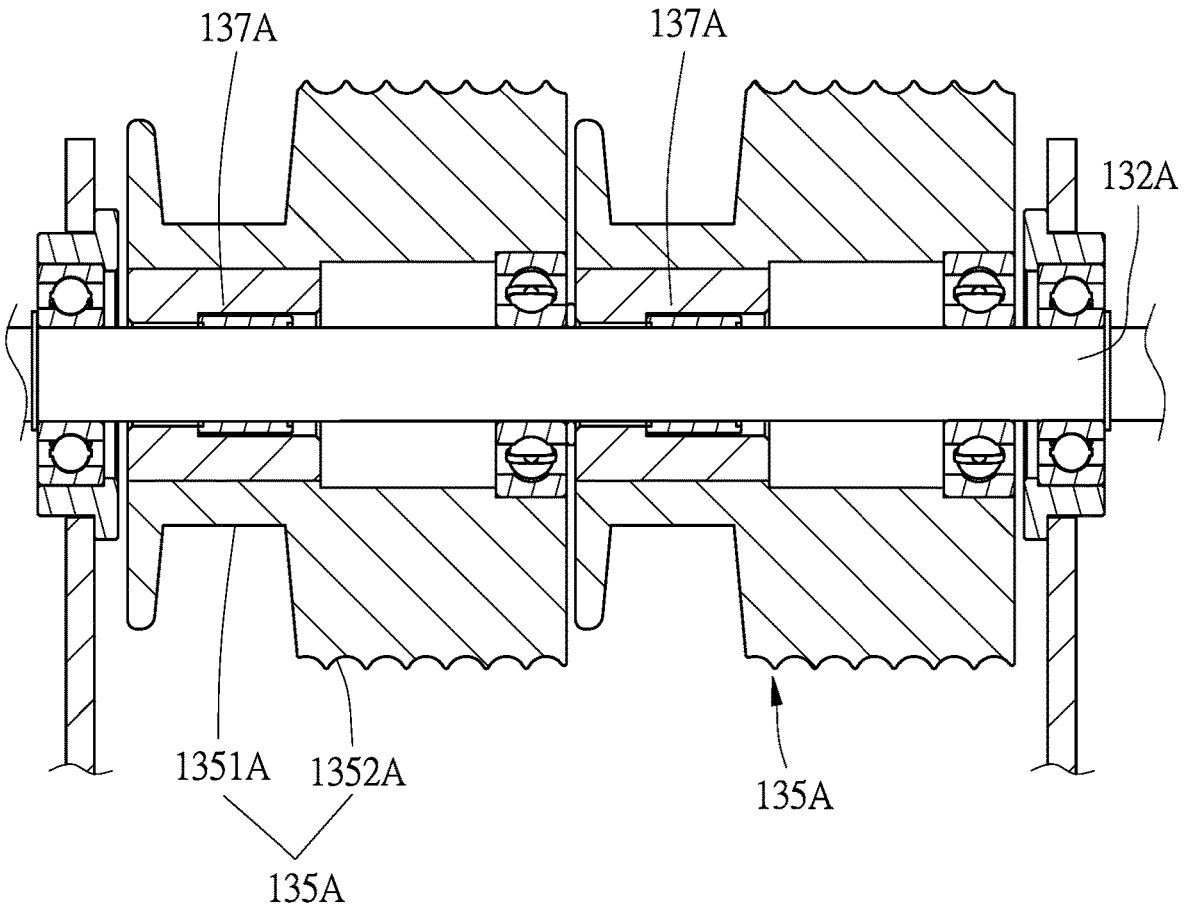
FIG. 19 is a partial cross-sectional view in accordance with the second embodiment of the present invention.

Referring to FIG. 18 and FIG. 19, the first resistance module (13A) further includes at least one movable sleeve (135A), at least one elastic cord (136A), at least one one-way bearing (137A), and at least one drive pulley (138A). The movable sleeve (135A) is rotatably mounted on the first rotator (132A) through the one-way bearing (137A), having the functions of unidirectional rotation and reverse idling. The movable sleeve (135A) has a first winding portion (1351A) and a second winding portion (1352A). The first winding portion (1351A) is configured for winding of a cord (1381A) of the drive pulley (138A). One end of the elastic cord (136A) is connected to the second winding portion (1352A). The other end of the elastic cord (136A) is wound around a plurality of elastic cord guide wheels (1361A) and then fixed to the main seat (101A). The elastic cord guide wheels (1361A) are fixed to the main seat (101A). Therefore, when the drive pulley (138A) is displaced, the drive pulley (138A) pulls the first rotator (132A) to rotate in a direction through the cord (1381A). During the rotation of the first rotator (132A), the elastic cord (136A) is pulled and the elastic cord (136A) is wound around the second winding portion (1352A), so that the return elastic force can be stored. When the drive pulley (138A) is displaced reversely, the elastic cord (136A) releases the stored elastic force. It should be noted that in this embodiment the movable sleeve (135A), the elastic cord (136A), the one-way bearing (137A) and the drive pulley (138A) are all plural, but they may be single. The number may be changed according to the actual needs. The one-way bearing (137A) drives the first rotator (132A) to rotate.

Figure 20:
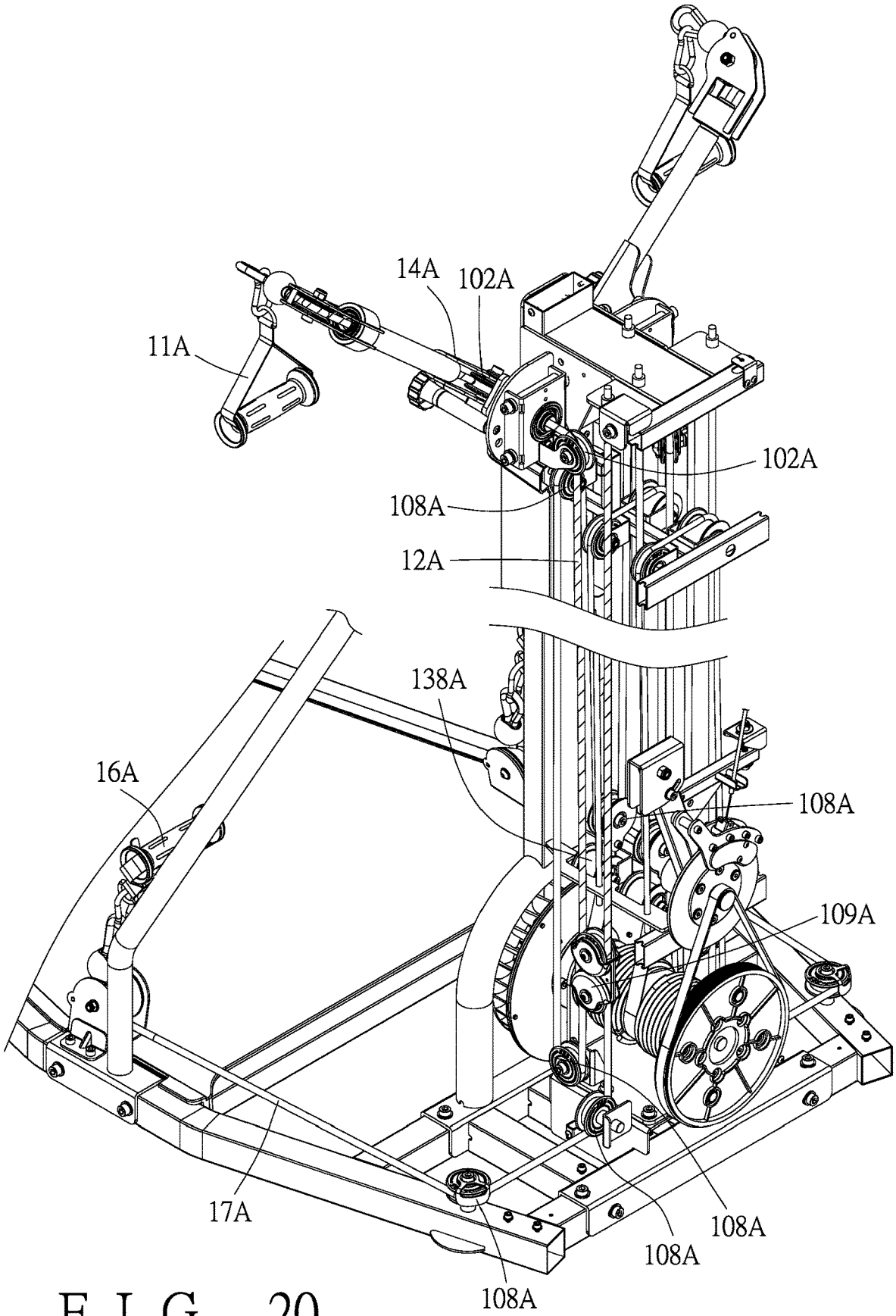
FIG. 20 is a perspective view in accordance with the second embodiment of the present invention, without the rope pulling machine.
Figure 21:
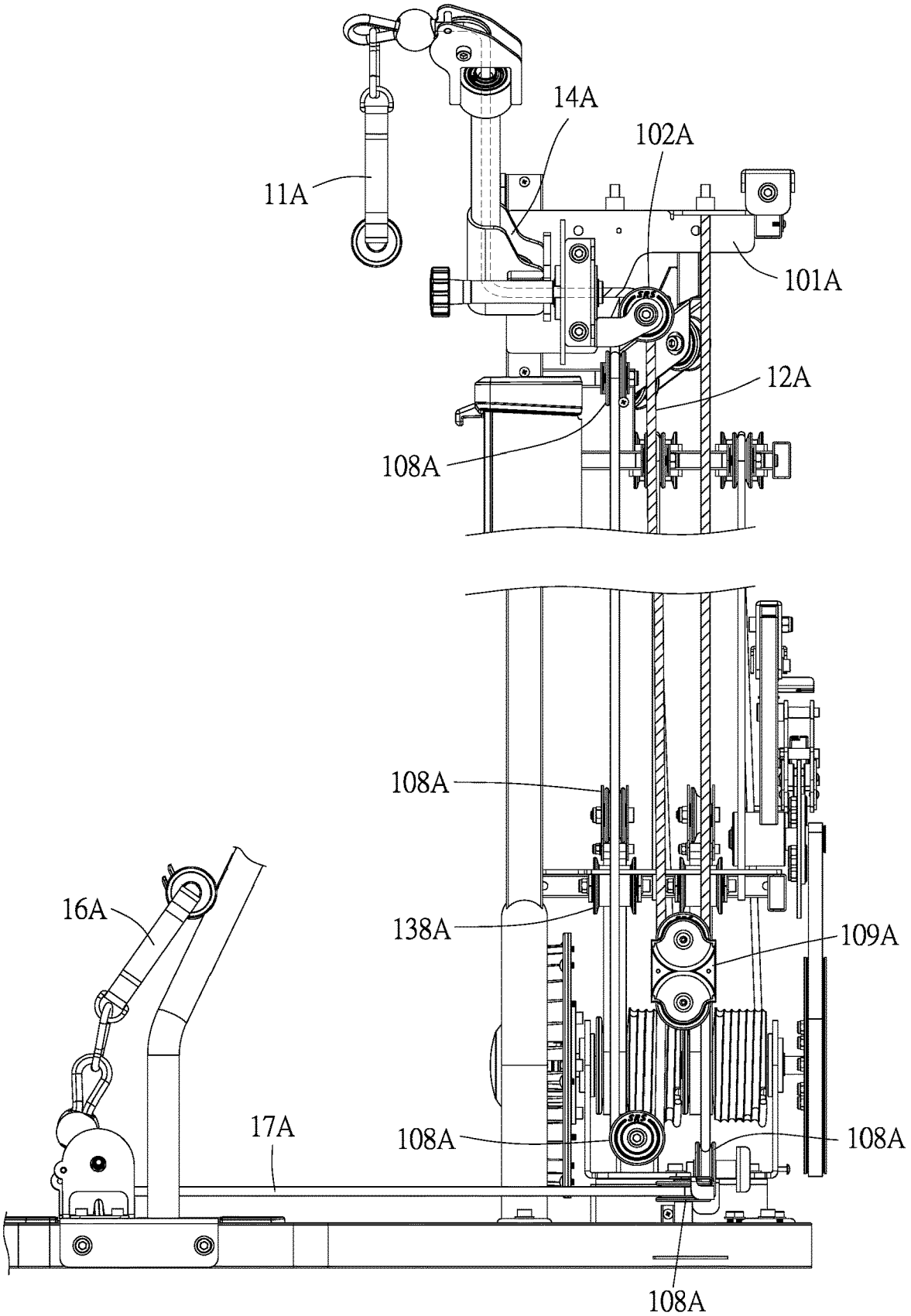
FIG. 21 is a side view in accordance with the second embodiment of the present invention, without the rope pulling machine.

With reference to FIG. 20 and FIG. 21, a set of the first handle (11A), the first pull rope (12A), the second handle (16A) and the second pull rope (17A) is as the representative. The linking structure of the first pull rope (12A), the second pull rope (17A) and the first resistance module (13A) will be further described in detail. One end of the first pull rope (12A) is connected to the first handle (11A), and the other end of the first pull rope (12A) is wound around at least one first guide winding member (102A) and a linking winding member (109A), and then the other end of the first pull rope (12A) is fixed to the top of the main seat (101A). The first guide winding member (102A) is immovable (for example, it is mounted to the main seat (101A) or the handle seat (14A). The linking winding member (109A) is movable. One end of the second pull rope (17A) is connected to the second handle (16A), and the other end of the second pull rope (17A) is wound around a plurality of second guide winding members (108A), the linking winding member (109A) and the drive pulley (138A). Then, the other end of the second pull rope (17A) is fixed to the top of the main seat (101A). Thereby, when the first handle (11A) pulls the first pull rope (12A) or the second handle (16A) pulls the second pull rope (17A), the drive pulley (138A) is pulled by the linking winding member (109A) to drive the first rotator (132A) to generate wind resistance and reluctance as a training load.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A combined exercise apparatus, comprising:

a lat pull-down machine, including at least a pair of first handles, a first pull rope and a first resistance module, the at least a pair of first handles being connected with the first resistance module through the first pull rope for providing lat pull-down training through the first resistance module, the lat pull-down machine further includes a pair of handle seats and a pair of angle adjustment members, the pair of first handles is mounted to the handle seats respectively, and the angle adjustment members are used to retain the position of the handle seats; and a rope pulling exercise machine, mounted to the lat pull-down machine, the rope pulling exercise machine comprising a rope, a wheel seat and a second resistance module, the rope of the rope pulling machine being located between the pair of handle seats and being wound around the wheel seat, the wheel seat being connected with the second resistance module for providing rope pulling training through the second resistance module, wherein the first resistance module of the lat pull-down machine and the second resistance module of the rope pulling exercise machine are independent from each other.

2. The combined exercise apparatus as claimed in claim 1, wherein the first resistance module includes a first seat and a first resistance unit, the first resistance unit includes a first rotator rotatably mounted to the first seat, the first rotator is linked by the first pull rope, the first rotator is provided with a plurality of blades arranged annularly to generate wind resistance when the first rotator is rotated; the first resistance unit further includes a first reluctance unit having at least one first magnet disposed in correspondence with the first rotator to generate a magnetic braking effect on the first rotator by inducing eddy currents therein; wherein the first resistance module further includes a first resistance adjustment module connected with the first resistance unit for adjusting the magnetic braking effect acting on the first rotator.

3. The combined exercise apparatus as claimed in claim 2, wherein the second resistance module includes a second seat and a second resistance unit, the second resistance unit includes a second rotator rotatably mounted to the second seat, the second rotator is linked by the wheel seat, the second resistance unit further includes a second reluctance unit having at least one second magnet disposed in correspondence with the second rotator to generate a magnetic braking effect on the second rotator by inducing eddy currents therein; wherein the second resistance module further includes a second resistance adjustment module connected with the second resistance unit for adjusting the magnetic braking effect acting on the second rotator.

4. The combined exercise apparatus as claimed in claim 3, wherein the first resistance adjustment module includes a first operation member and a first pull cord, the first pull cord is connected with the first operation member and the first resistance unit, when the first operation member is turned, the first operation member drives the first resistance unit through the first pull cord for adjusting the first resistance unit to correspond to the position of the first rotator.

5. The combined exercise apparatus as claimed in claim 4, wherein the second resistance unit is movably mounted to the second seat, the second resistance adjustment module includes a second operation member and a second pull cord, the second pull cord is connected with the second operation member and the second resistance unit, when the second operation member is turned, the second operation member drives the second resistance unit through the second pull cord for adjusting the second resistance unit to correspond to the position of the second rotator.

6. The combined exercise apparatus as claimed in claim 5, wherein the lat pull-down machine further comprises a main seat, the first seat and the second seat are mounted to the main seat to form an integral structure.

7. The combined exercise apparatus as claimed in claim 1, wherein the lat pull-down machine further includes a second handle and a second pull rope, the second pull rope is connected with the second handle and the first resistance module, so that the second handle and the first handle share the first resistance module.

8. A combined exercise apparatus comprising:

a lat pull-down machine, including a first handle, a first pull rope and a first resistance module, the first handle being connected with the first resistance module through the first pull rope for providing lat pull-down training through the first resistance module the first resistance module includes a first seat, a first rotator, at least one movable sleeve, at least one elastic cord, at least one one-way bearing and at least one drive pulley, the first rotator is rotatably mounted to the first seat, the first rotator is linked by the first pull rope, the first rotator is provided with a plurality of blades arranged annularly, the blades are used to generate wind resistance, the movable sleeve is rotatably mounted on the first rotator through the one-way bearing, the movable sleeve has a first winding portion and a second winding portion, the first winding portion is configured for winding of a cord of the drive pulley, one end of the elastic cord is connected to the second winding portion, the drive pulley is linked by the first pull rope, so that the drive pulley pulls the first rotator to rotate through the cord, and the elastic cord is wound around the second winding portion to store a return elastic force; and a rope pulling exercise machine, mounted to the lat pull-down machine, the rope pulling exercise machine comprising a rope, a wheel seat and a second resistance module, the rope being wound around the wheel seat, the wheel seat being connected with the second resistance module for providing rope pulling training through the second resistance module, wherein the first resistance module of the lat pull-down machine and the second resistance module of the rope pulling exercise machine are independent from each other.

9. The combined exercise apparatus as claimed in claim 8, wherein the first resistance module further includes a first resistance unit, the first rotator further includes a pulley, the pulley drives a second rotator to rotate through a belt, the pulley has a diameter greater than that of the second rotator, the first resistance unit includes a first reluctance unit, the first reluctance unit corresponds to the second rotator for the second rotator to generate reluctance.

10. A combined exercise apparatus, comprising a lat pull-down machine and a rope pulling exercise machine, the rope pulling exercise machine being mounted to the lat pull-down machine to thereby be integrated with each other; the lat pull-down machine including a first handle, a first pull rope and a first resistance module, the first handle being connected with the first resistance module through the first pull rope for providing lat pull-down training through the first resistance module, the first resistance module includes a first seat, a first rotator, at least one movable sleeve, at least one elastic cord, at least one one-way bearing and at least one drive pulley, the first rotator is rotatably mounted to the first seat, the first rotator is linked by the first pull rope, the first rotator is provided with a plurality of blades arranged annularly, the blades are used to generate wind resistance, the movable sleeve is rotatably mounted on the first rotator through the one-way bearing, the movable sleeve has a first winding portion and a second winding portion, the first winding portion is configured for winding of a cord of the drive pulley, one end of the elastic cord is connected to the second winding portion, the drive pulley is linked by the first pull rope, so that the drive pulley pulls the first rotator to rotate through the cord, and the elastic cord is wound around the second winding portion to store a return elastic force.

* * * * *